US009597809B2

(12) United States Patent
Onion

(10) Patent No.: US 9,597,809 B2
(45) Date of Patent: Mar. 21, 2017

(54) EASILY DISASSEMBLED FOLDING KNIFE

(71) Applicant: GB II Corporation, Tualatin, OR (US)

(72) Inventor: Kenneth J. Onion, Kaneohe, HI (US)

(73) Assignee: GB II Corporation, Tualatin, OR (US)

( * ) Notice: Subject to any disclaimer, the term of this patent is extended or adjusted under 35 U.S.C. 154(b) by 173 days.

(21) Appl. No.: 14/197,120

(22) Filed: Mar. 4, 2014

(65) Prior Publication Data

US 2014/0245616 A1 Sep. 4, 2014

Related U.S. Application Data

(60) Provisional application No. 61/772,449, filed on Mar. 4, 2013.

(51) Int. Cl.

| | |
|---|---|
| ***B26B 1/02*** | (2006.01) |
| ***B26B 1/04*** | (2006.01) |
| ***B26B 1/10*** | (2006.01) |

(52) U.S. Cl.

CPC ..... *B26B 1/04* (2013.01); *B26B 1/044* (2013.01); *B26B 1/10* (2013.01); *Y10T 29/4984* (2015.01)

(58) Field of Classification Search

CPC .. B26B 1/04; B26B 1/044; B26B 1/10; Y10T 29/4984

USPC ..... 30/155, 156, 157, 160, 164

See application file for complete search history.

(56) References Cited

U.S. PATENT DOCUMENTS

| | | | |
|---|---|---|---|
| 298,115 | A | 5/1884 | Peace |
| 1,049,931 | A | 1/1913 | Smith |
| 1,299,173 | A | 4/1919 | Grey |
| 1,350,251 | A | 8/1920 | Armour |
| 1,428,296 | A | 9/1922 | Neft |
| 1,487,655 | A | 3/1924 | Hlavacek |
| 1,667,462 | A | 4/1928 | Logan |
| 3,061,927 | A | 11/1962 | Von Frankenberg Und Ludwigsdorf |
| 3,829,967 | A | 8/1974 | Gilbert |

(Continued)

FOREIGN PATENT DOCUMENTS

| | | | |
|---|---|---|---|
| CN | CN2194827 | Y | 4/1995 |
| CN | CN2902614 | Y | 5/2007 |

(Continued)

OTHER PUBLICATIONS

Office Action dated Sep. 24, 2015, issued by the United States Patent and Trademark Office in U.S. Appl. No. 14/197,090, filed Mar. 4, 2014.

(Continued)

*Primary Examiner* — Omar Flores Sanchez

(74) *Attorney, Agent, or Firm* — Klarquist Sparkman, LLP

(57) ABSTRACT

Disclosed herein are embodiments of easily disassembled folding knives. In some embodiments, a folding knife includes a blade and a handle including first and second side portions. The first and second side portions can include respective locking elements which can be used to retain the side portions from lateral separation from one another. In some cases, the locking elements of one side portion include relatively narrow neck portions with relatively wide, non-circular head portions connected to the neck portions, and the locking elements of the other side portion include a recess and a corresponding non-circular opening. In some cases, folding knives can be provided with washers, liner lock mechanisms, and various other features.

19 Claims, 17 Drawing Sheets

(56) References Cited

U.S. PATENT DOCUMENTS

| | | | | |
|---|---|---|---|---|
| 4,218,819 | A | 8/1980 | Phelps | |
| 4,730,393 | A | 3/1988 | Coburn | |
| 5,022,156 | A | 6/1991 | Kallens et al. | |
| 5,594,966 | A | 1/1997 | Goldman | |
| 5,605,495 | A | 2/1997 | Jenkins, Jr. | |
| 5,661,908 | A | 9/1997 | Chen | |
| 5,916,277 | A | 6/1999 | Dallas | |
| 6,101,723 | A * | 8/2000 | Ford | B26B 1/044 30/157 |
| 6,134,788 | A | 10/2000 | Chen et al. | |
| 6,751,820 | B1 | 6/2004 | Wu | |
| 6,802,126 | B2 | 10/2004 | Huang | |
| 6,942,255 | B2 * | 9/2005 | Pickering | F16L 37/252 285/136.1 |
| 7,100,285 | B1 | 9/2006 | Huang | |
| 7,162,803 | B2 | 1/2007 | Lu | |
| 7,246,441 | B1 * | 7/2007 | Collins | B26B 1/042 30/159 |
| 7,370,421 | B2 | 5/2008 | Onion et al. | |
| 7,716,839 | B2 | 5/2010 | Onion et al. | |
| 8,051,518 | B2 | 11/2011 | Massaro | |
| 8,087,173 | B2 | 1/2012 | Tang et al. | |
| 2008/0222896 | A1 | 9/2008 | Marfione et al. | |
| 2012/0011728 | A1 | 1/2012 | Keers | |
| 2012/0124754 | A1 | 5/2012 | Frazer | |

FOREIGN PATENT DOCUMENTS

| | | | |
|---|---|---|---|
| CN | CN201471444 | U | 5/2010 |
| CN | CN201500984 | U | 6/2010 |
| WO | WO99/00224 | A2 | 1/1999 |

OTHER PUBLICATIONS

First Office Action and Search Report (including English translation) from State Intellectual Property Office of the People's Republic of China, for Chinese Patent Application No. 20140076626.0, dated Jun. 10, 2015, 15 pages.

* cited by examiner

EASILY DISASSEMBLED FOLDING KNIFE

CROSS REFERENCE TO RELATED APPLICATIONS

This application claims the benefit of U.S. Provisional Patent Application No. 61/772,449, filed Mar. 4, 2013, which application is hereby incorporated herein by reference in its entirety.

FIELD

The present disclosure relates to folding knives and, more particularly, to folding knives configured to be easily disassembled.

BACKGROUND

Folding knives are available in various configurations. In some of these configurations, the blade of a folding knife can be removable to facilitate cleaning, sharpening, replacement, or storing of a blade. As examples, U.S. Pat. Nos. 7,370,421 and 7,716,839 describe a knife having a removable blade. Because folding knives having removable blades are particularly advantageous in harsh conditions (i.e., in situations where a knife is likely to become dirty or dull, and thus where the ability to clean, sharpen, or replace a blade in the field is important), it would be beneficial to provide a folding knife with a removable blade having as simple a structure as possible. Simpler configurations can help to ensure that the blade remains easily removable after use in harsh conditions and that removal of the blade can be accomplished as quickly and reliably as possible. Accordingly, simple mechanisms allowing a folding knife to be easily disassembled are desirable.

SUMMARY

The present disclosure is directed toward new and non-obvious methods and apparatuses relating to folding knives. In one embodiment, a folding knife comprises a handle portion including first and second, laterally spaced side portions defining a blade-receiving cavity therebetween, a pivot element coupled to the first side portion, a blade pivotably connected to the pivot element of the handle portion and pivotable relative to the handle portion about the pivot element between a closed position and an open position, and a locking element having a non-circular shape coupled to the pivot element.

The second side portion can include a non-circular opening and can be adapted to be rotatable relative to the first side portion about an axis extending through the locking element between a first position and a second position, wherein when the second side portion is in the first position, the opening is rotationally offset from the locking element, and the locking element blocks lateral movement of the second side portion relative to the first side portion, and wherein when the second side portion is in the second position, the opening is rotationally aligned with the locking element to allow the locking element to be moved through the opening to permit lateral movement of the second side portion away from the first side portion along the axis.

In other embodiments, the folding knife can also include a securing mechanism configured to selectively retain the second side portion against rotational movement relative to the first side portion when the second side portion is in the first position. The second side portion can be rotationally aligned with the first side portion when the second side portion is in the first position. The pivot element can extend through an opening in the blade and the blade can be removable from the pivot element in a direction along the axis when the second side portion is first moved away from the first side portion along the axis. Finally, the locking element can have a hexagonal cross section and the opening can be hexagonal.

In some embodiments, a folding knife comprises a handle portion comprising first and second, laterally spaced side portions defining a blade-receiving cavity therebetween, a pivot element coupled to the first side portion and defining a pivot axis, a blade pivotably connected to the pivot element of the handle portion and pivotable relative to the handle portion about the pivot axis between a closed position and an open position, and a locking element having a non-circular shape coupled to the pivot element, wherein the second side portion comprises a non-circular opening, the second side portion configured to move the non-circular opening between a first, locking position and a second, release position, wherein when the non-circular opening is in the first position, the opening is rotationally offset from the locking element, and the locking element blocks lateral movement of the second side portion relative to the first side portion, and wherein when the non-circular opening is in the second position, the opening is rotationally aligned with the locking element to allow the locking element to be moved through the opening to permit lateral movement of the second side portion away from the first side portion along the pivot axis.

In some embodiments, a folding knife comprises a handle portion comprising first and second, laterally spaced side portions defining a blade-receiving cavity therebetween, a pivot element coupled to the first side portion, a blade pivotably connected to the pivot element of the handle portion and pivotable relative to the handle portion about the pivot element between a closed position and an open position, and a locking element having a non-circular shape coupled to the pivot element, wherein the second side portion comprises a non-circular opening and is adapted to be rotatable relative to the first side portion about an axis extending through the locking element between a first position and a second position, wherein when the second side portion is in the first position, the opening is rotationally offset from the locking element, and the locking element blocks lateral movement of the second side portion relative to the first side portion, and wherein when the second side portion is in the second position, the opening is rotationally aligned with the locking element to allow the locking element to be moved through the opening to permit lateral movement of the second side portion away from the first side portion along the axis.

In some embodiments, a method of assembling a folding knife comprises sliding an opening in a blade of the folding knife over a non-circular locking portion, an intermediate portion, and a pivot element of a first side portion of a handle of the knife, positioning a second side portion such that a non-circular opening in the second side portion is rotationally aligned with the locking portion, sliding the opening of the second side portion over the locking portion and the intermediate portion, and rotating the opening such that the opening is rotationally offset from the locking portion.

In some embodiments, a folding knife comprises a handle portion comprising first and second, laterally spaced side portions defining a blade-receiving cavity therebetween, a pivot element coupled to the first side portion and defining a pivot axis, a blade pivotably connected to the pivot element of the handle portion and pivotable relative to the handle portion about the pivot axis between a closed position and an open position, and a blade sharpening element coupled to the inner surface of one of the first and second side portions, wherein the first and second side portions can be disassembled from each other to permit use of the sharpening element.

In some embodiments, a folding knife comprises a handle portion comprising first and second, laterally spaced side portions defining a blade-receiving cavity therebetween, a pivot element coupled to the first side portion and defining a pivot axis, a blade pivotably connected to the pivot element of the handle portion and pivotable relative to the handle portion about the pivot axis between a closed position and an open position, at least one recessed compartment formed in the inner surface of one or both of the first and second side portions, and one or more tools stored in the compartment, wherein the first and second side portions can be disassembled from each other to gain access to the one or more tools in the compartment.

In some embodiments, a folding knife comprises a handle portion comprising first and second, laterally spaced side portions defining a blade-receiving cavity therebetween, a pivot element coupled to the first side portion and defining a pivot axis, a blade pivotably connected to the pivot element of the handle portion and pivotable relative to the handle portion about the pivot axis between a closed position and an open position, and a locking element having a non-circular shape coupled to the pivot element, wherein the second side portion comprises a lock that is rotatable with respect to the locking element, wherein the lock comprises a non-circular opening such that rotation of the lock with respect to the locking element causes the non-circular opening to rotate between a first, locking position and a second, release position, wherein when the non-circular opening is in the first position, the opening is rotationally offset from the locking element, and the locking element blocks lateral movement of the second side portion relative to the first side portion, and wherein when the non-circular opening is in the second position, the opening is rotationally aligned with the locking element to allow the locking element to be moved through the opening to permit lateral movement of the second side portion away from the first side portion along the pivot axis.

The foregoing and other objects, features, and advantages of the invention will become more apparent from the following detailed description, which proceeds with reference to the accompanying figures.

BRIEF DESCRIPTION OF THE DRAWINGS

FIGS. 15B-19 show various components of the folding knife of FIG. 15A.

DETAILED DESCRIPTION

The present disclosure concerns folding knives that can be more easily disassembled than known folding knives, such as for cleaning or replacing a blade or other components. For example, folding knives disclosed herein can be manually disassembled, that is, disassembled without the use of additional tools (e.g., without a screwdriver, etc.). In some cases, easily disassembled folding knives include a handle having first and second side portions having complementary locking elements which can prevent the side portions from being separated from one another.

Figure 1:
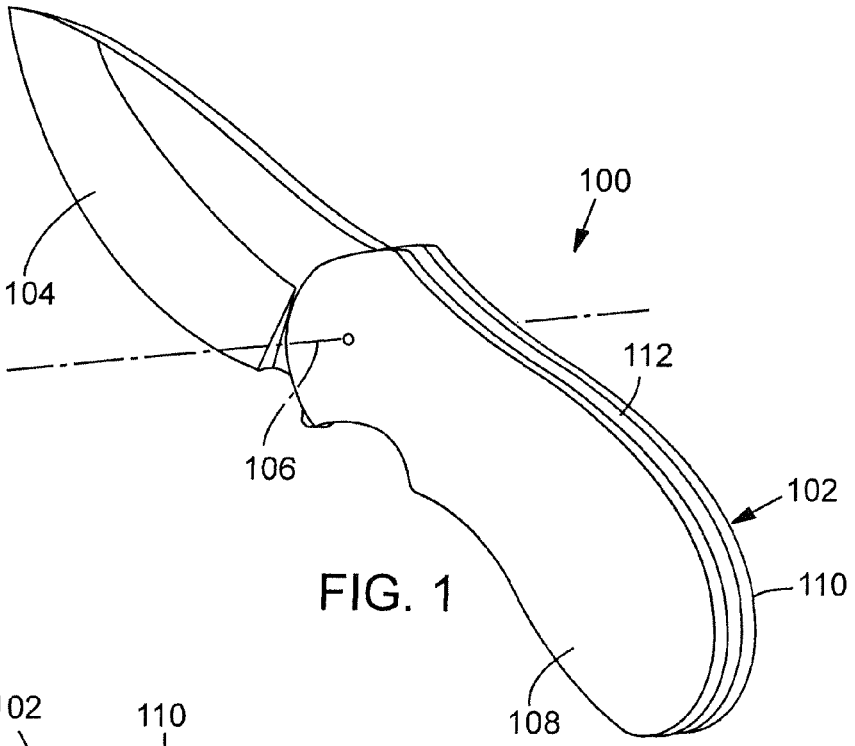
FIG. 1 is a perspective view of an exemplary folding knife.
Figure 2:
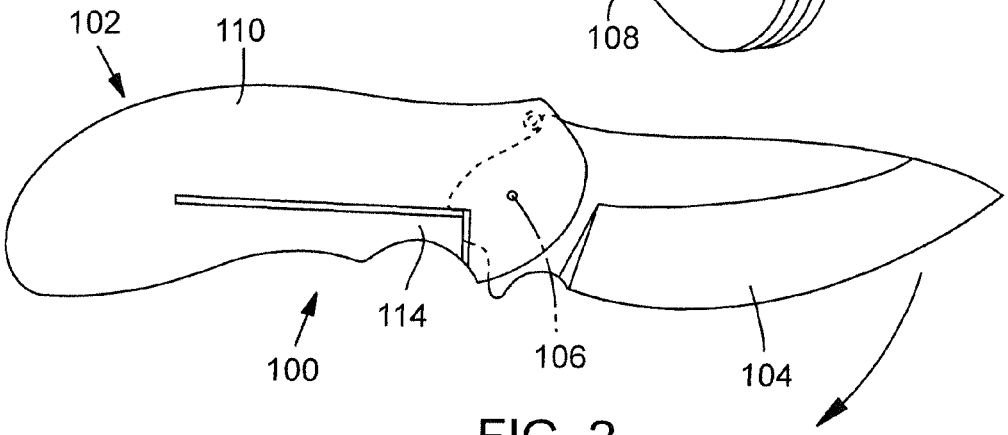
FIGS. 2 and 3 are side views of the folding knife of FIG. 1 in an open configuration and a closed configuration, respectively.
Figure 3:
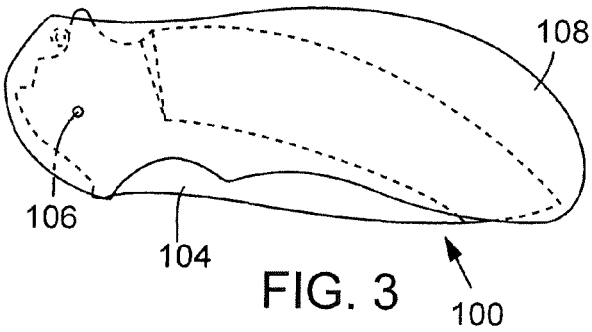

Referring to FIGS. 1-3, a first embodiment of a folding knife 100 can include a handle portion 102 and a blade 104. The blade 104 can be pivotably connected to the handle 102 such that the blade 104 can be pivoted about an axis 106 between an open position for using the blade (as shown in FIG. 2) and a closed position for storing the blade (as shown in FIG. 3). The handle 102 can include a first side portion 108 and a second side portion 110. The first and second side portions can be spaced apart from each other by a distance, thereby defining a blade receiving channel 112 between the two side portions for receiving the blade when it is pivoted to its closed position. As shown in FIG. 2, the first side portion 108 can include a leaf spring 114 (known as a "liner lock" or a "frame lock") that is biased into a position engaging the rear edge of the tang of the blade 104 to retain the blade in the open position, as is known in the art.

Figure 4A:
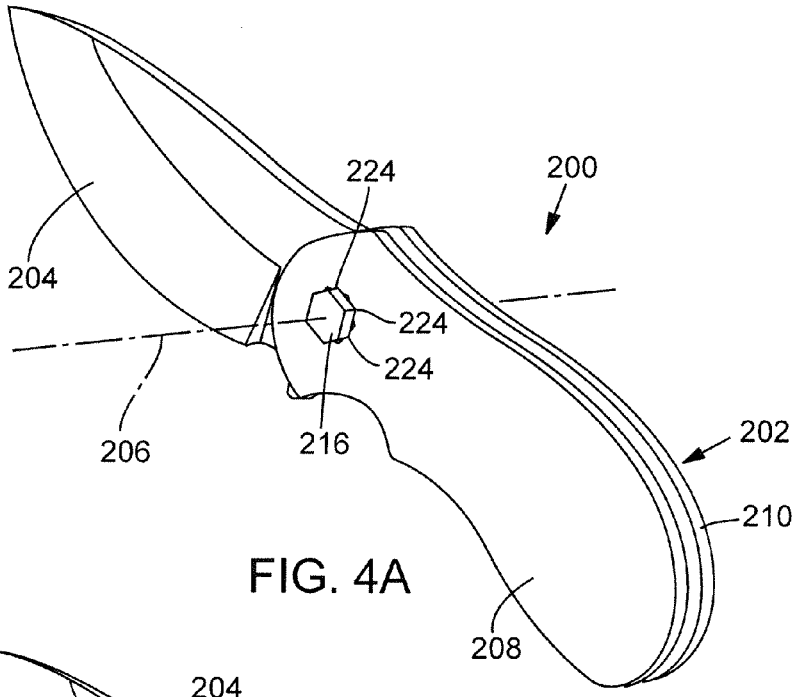
FIGS. 4A and 4B show a perspective view and a perspective, exploded view of another exemplary folding knife, respectively.
Figure 4B:
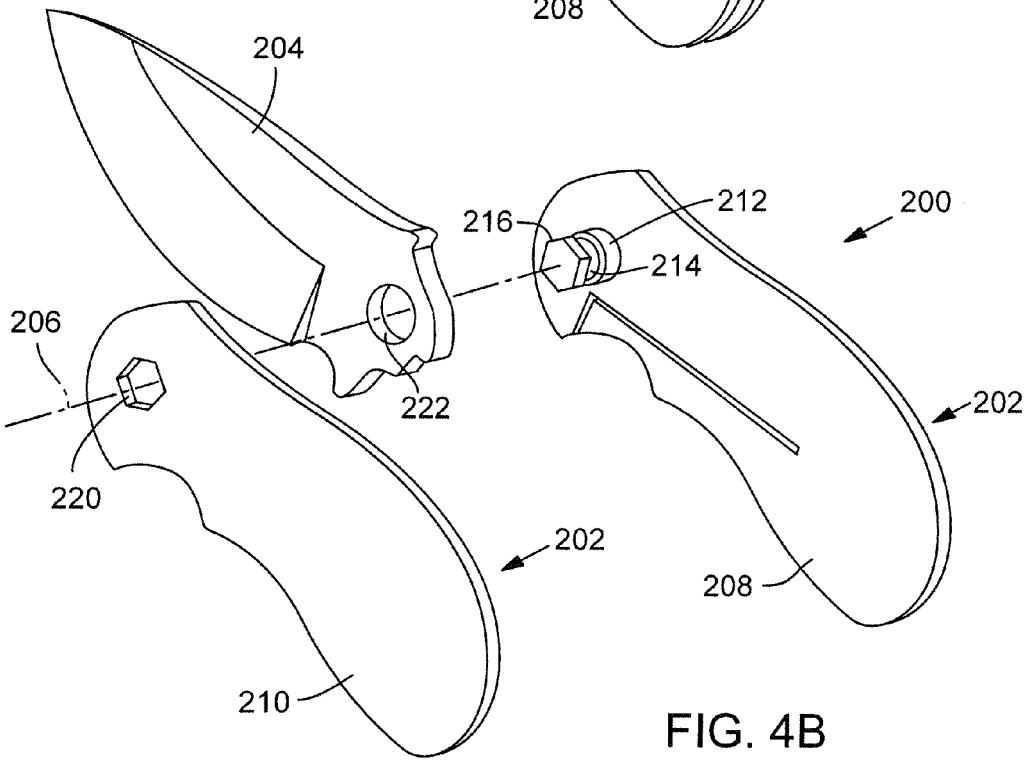
Figure 5:
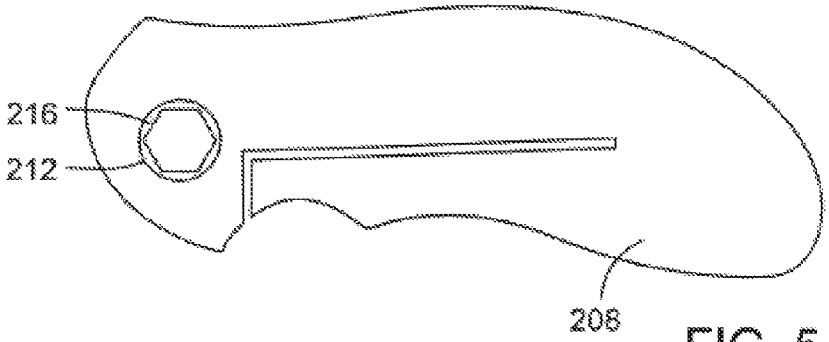
FIGS. 5 and 6 show side and bottom views, respectively, of a side portion of the folding knife of FIGS. 4A and 4B.
Figure 6:
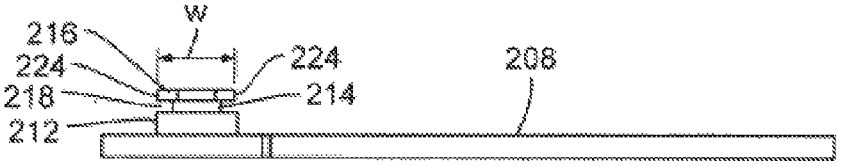
Figure 7:
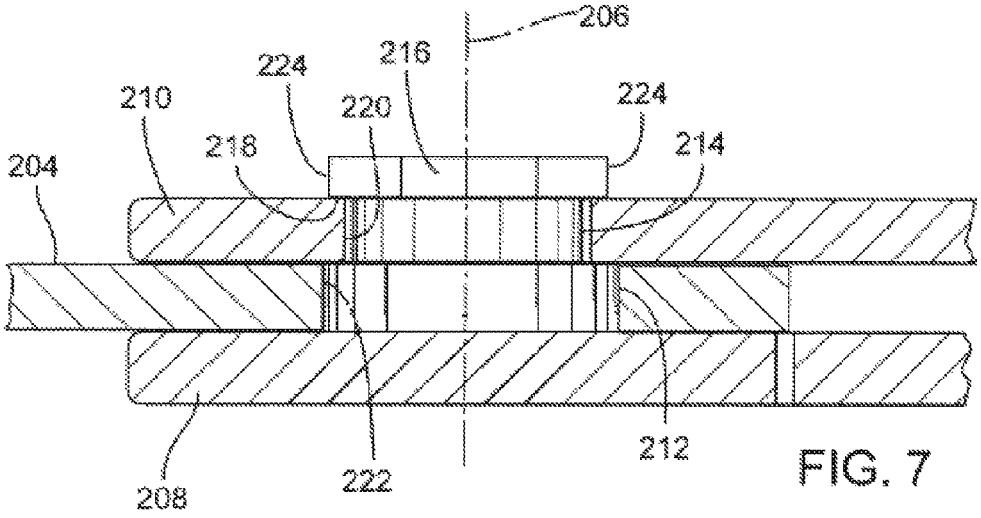
FIG. 7 shows a bottom cross-sectional view of a portion of the folding knife of FIGS. 4A and 4B.

FIGS. 4-8 illustrate one embodiment of a folding knife 200 including a handle portion 202 and a blade 204 pivotably connected to the handle 202 for pivoting motion about an axis 206. The handle 202 can include a first side portion 208 and a second side portion 210. FIG. 4A illustrates a perspective view of the knife 200. FIG. 4B illustrates an exploded perspective view of the knife 200. FIGS. 5 and 6 illustrate side and bottom views, respectively, of the first side portion 208. As shown, a primary raised cylindrical protrusion 212, which functions as a pivot element or pivot pin for the blade, can extend laterally from the inner surface of the first side portion 208. The central longitudinal axis of the primary cylindrical protrusion 212 can be aligned with the pivot axis 206. As also shown in FIGS. 5-6, a secondary raised cylindrical portion 214 can extend laterally from the inner side surface of the primary cylindrical protrusion 212. As shown, the diameter of the secondary cylindrical portion 214 can be smaller than the diameter of the primary cylindrical portion 212, and the central longitudinal axis of the secondary protrusion 214 can be aligned with the central longitudinal axis of the primary protrusion 212 and the pivot axis 206.

As also shown in FIGS. 5-6, a hexagonal locking portion, or locking element, 216 can be attached to the inner side surface of the secondary protrusion 214. As shown, the width W of the locking portion 216 can be greater than the diameter of the secondary protrusion 214, so that a locking channel 218 is thereby defined between the primary protrusion 212 and the locking portion 216. The width of the channel 218 (the distance between the pivot pin 212 and the locking element 216) is sized to receive the second side portion 210, as further described below. As shown in FIGS. 5-6, the thickness of each of the first side portion 208, the primary protrusion 212, the secondary protrusion 214, and the locking portion 216 along the pivot axis are approximately the same. In alternative embodiments, however, the precise thicknesses of each of these components along the pivot axis can be any suitable length, and are independent of one another.

As best shown in FIG. 4B, the second side portion 210 can include a hexagonal opening 220 that extends through the entire second side portion 210. The hexagonal opening 220 can be advantageously sized so that it is only slightly larger than the hexagonal locking portion 216 of the first side portion 208. The opening 220 can be further configured such that when the first and second side portions are placed adjacent one another in an assembled, as-used configuration, the hexagonal shape of the opening 220 is rotationally offset about the pivot axis 206 from the hexagonal shape of the locking portion 216. As best shown in FIG. 4B, the hexagonal shape of the opening 220 can be rotationally offset from the hexagonal shape of the locking portion 216 by approximately 30 degrees (1/12 of a full rotation), such that the corners of the two hexagonal shapes are rotationally offset from each other as far as possible. The blade 204 can have a circular opening 222. The circular opening 222 can be sized so that its diameter is larger than both the width of the locking portion 216 and the diameter of the primary protrusion 208.

While the illustrated embodiment includes a hexagonal locking element 216 and corresponding hexagonal opening 220, the locking element 216 and the corresponding opening 220 can be any of various shapes. In general, a knife can comprise a locking element (e.g., locking element 216) having a non-circular cross-sectional shape (taken along a plane perpendicular to the pivot axis 206) that extends through an opening (e.g., opening 220) of the same or similar shape in a side portion of the handle. The locking element 216 and corresponding opening 220 can be any of various shapes, such as, without limitation, square, triangular, cruciform (cross shaped), etc. It should be noted that in any of the embodiments disclosed herein, wherever a first component has a non-circular cross-sectional shape that fits though a correspondingly shaped opening in a second component, the shape of the first component and the opening can be any of various shapes, including but not limited to a square, hexagon, triangle, cruciform, oval, etc.

In use, the non-circular locking element cooperates with the non-circular opening to prevent lateral separation of the side portions 208, 210 of the handle when the locking element is rotationally offset from the opening. Conversely, rotating the second side portion 210 such that the opening 220 is rotationally aligned with the locking element 216 allows lateral separation of the side portions 208, 210 of the handle. In certain embodiments, the shape of the opening 220 need not correspond exactly to the cross-sectional shape of the locking element 216. In particular, the opening 220 in the side portion 210 can have any non-circular shape that is sized and shaped: (1) to allow the locking element 216 to slide through the opening 220 when the side portion 210 is in a first rotational position in which the opening 220 is rotationally aligned with the locking element 216 and (2) to block the locking element 216 from sliding through the opening 220 when the side portion 210 is in a second rotational position in which the opening 220 is rotationally offset from the locking element 216. As used herein, the term "rotationally aligned" means that the opening 220 in the side portion 210 is in a rotational position relative to the locking element 216 about a central axis (e.g., pivot axis 206) extending through the opening and the locking element such that the locking element can fit or slide through the opening in a direction along the axis 206. The term "rotationally offset" means that the opening 220 in the side portion 210 is in a rotational position relative to the locking element 216 about the central axis 206 extending through the opening and the locking element such that the locking element cannot fit or slide through the opening in a direction along the axis 206.

Figure 8:
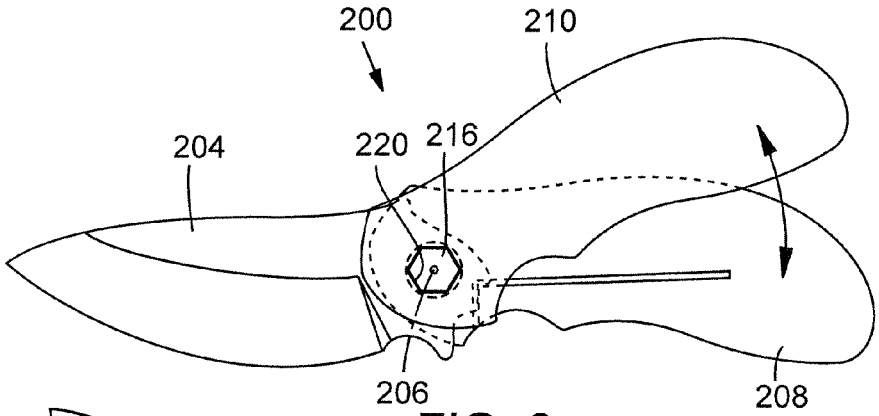
FIG. 8 shows the folding knife of FIGS. 4A and 4B in a partially assembled state.

The folding knife 200, comprising the first side portion 208, the second side portion 210, and the blade 204, as described above, can be assembled by sliding the opening 222 of the blade over the locking portion 216, the secondary protrusion 214, and the primary protrusion 212, such that the blade 204 rests against the first side portion 208. Referring to FIG. 8, the folding knife 200 can be further assembled by positioning the second side portion 210 so that it is rotationally offset around the axis 206 from the first side portion 208 by about 30 degrees, so that the hexagonal shape of the opening 220 and the hexagonal shape of the locking portion 216 are generally aligned, and then sliding the hexagonal opening 220 of the second side portion 210 over the locking portion 216 and the secondary protrusion 214 until the second side portion 210 rests within the locking channel 218 adjacent the blade. In this configuration, the central longitudinal axis of the protrusions 212, 214, and the locking portion 216, as well as of the opening 222 in the blade 204 and the opening 220 in the second side portion 210 are aligned with the pivot axis 206.

The second side portion 210 can then be rotated from the position shown in FIG. 8 until it is rotationally aligned with the first side portion 208, and such that the hexagonal shape of the opening 220 is rotationally offset from the hexagonal shape of the locking portion 216. In this configuration, the corners 224 of the locking portion 216 extend beyond the edges of the opening 220, thereby preventing the second side portion 210 from being removed in a lateral direction away from the first side portion 208, and thereby also preventing the blade 204 from being removed from the rest of the knife 200. In order to remove the second side portion 210 from the first side portion 208, the second side portion 210 can be rotated about 30 degrees from the first side portion 208 such that the corners of the locking portion 216 no longer capture the second side portion 210, as in the configuration shown in FIG. 8, which can then slide laterally away from the first side portion 208 along the axis 206. Mechanisms for retaining the second side portion 210 against rotation relative to the first side portion 208 in the as-use position are described in detail below.

The first side portion 208 can be formed integrally, with the primary cylindrical protrusion 212, the secondary protrusion 214, and the locking portion 216 all being formed from a single piece of material, or each of these components can be formed separately and joined later in the fabrication process, such as by welding. Alternatively, the primary protrusion 212, the secondary protrusion 214, and the locking portion 216 can be an integral component that is removably secured to the first side portion, such as with a screw or other removable fastener. Each of the components of the knife 200 can be formed of various materials, including metals, plastics, and/or composites.

Figure 9:
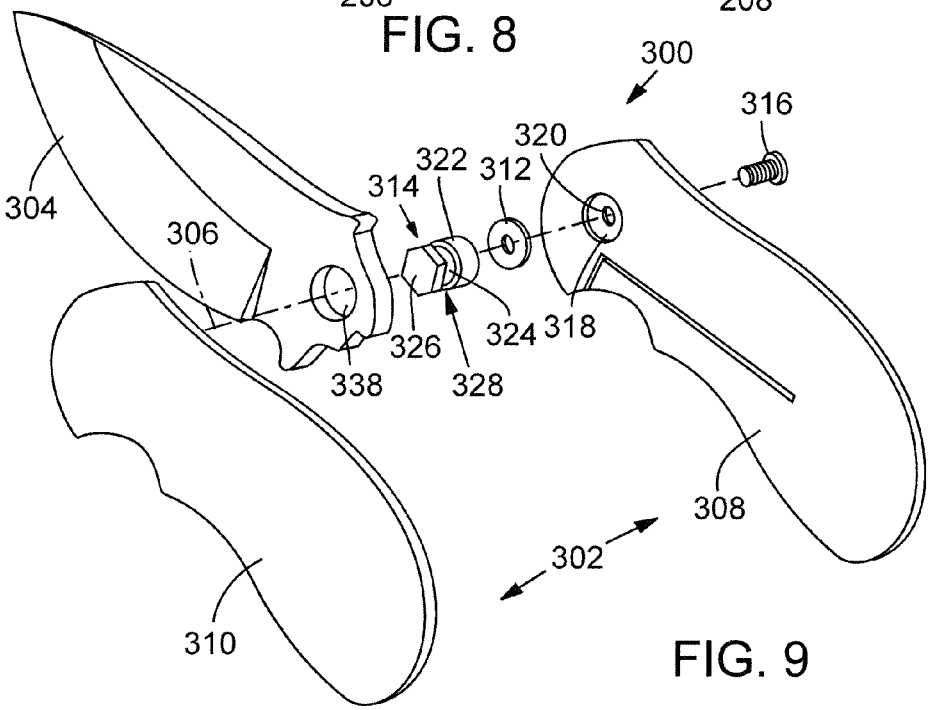
FIG. 9 shows a perspective, exploded view of another exemplary folding knife.
Figure 10:
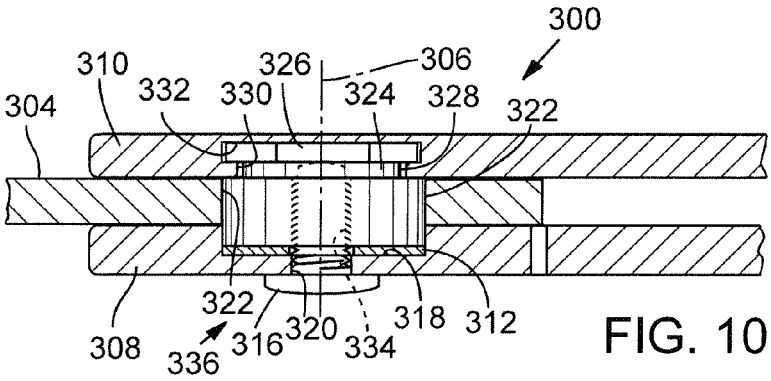
FIG. 10 shows a bottom cross-sectional view of a portion of the folding knife of FIG. 9.

FIGS. 9-10 illustrate another embodiment of a folding knife 300 which can include a blade 304 pivotably connected to a handle portion 302 for pivoting motion about an axis 306. The handle 302 can include a first side portion 308, a second side portion 310, a washer 312, a pivot and locking element 314, and a locking screw 316. FIG. 9 illustrates an exploded perspective view of the knife 300.

The first side portion 308 can include a cylindrical recess 318 formed in the inner surface of the first side portion 308 and having a central longitudinal axis aligned with the pivot axis 306. A circular opening 320 also having a central longitudinal axis aligned with the pivot axis 306 can extend from the end of the recess 318 to the outer surface of the first side portion 308. The washer 312 can be configured to be positioned within the recess 318. The washer 312 can be secured within the recess 318, such as with an adhesive or a press-fit configuration, to prevent the washer from being removed when the knife is disassembled.

The pivot and locking element 314 can comprise a first cylindrical portion 322 coupled to a second cylindrical portion 324, itself coupled to a hexagonal locking portion 326. The cylindrical portion 322 functions as the pivot pin or pivot element for the blade. The first cylindrical portion 322 can have a threaded recess 334 at one end configured to receive the locking screw 316 and can have a diameter which is larger than the diameter of the second cylindrical portion 324. The hexagonal portion 326 can have a width which is also larger than the diameter of the second cylindrical portion 324. Thus, a locking channel 328 can be defined between the first cylindrical portion 322 and the hexagonal portion 326 for receiving the second side portion 310. The screw 316 can be configured to engage the threaded recess of the first cylindrical portion 322, and can have a head having a diameter larger than the diameter of the opening 320.

An assembly 336 can comprise the first side portion 308, washer 312, pivot and locking element 314, and locking screw 316. The assembly 336 has a structure similar to that of the first side portion 208 of the knife 200. The blade 304 can have a cylindrical opening 338 which has a diameter greater than the diameters of the first cylindrical portion 322 and the second cylindrical portion 324, and greater than the width of the hexagonal portion 326.

The second side portion 310 can include a hexagonal recess 330 in communication with a cylindrical cavity 332 contained entirely within the second side portion 310. The hexagonal recess 330 can advantageously be sized so that it is slightly larger than the hexagonal portion 326 of the assembly 336. When the assembly 336 and the second side portion 310 are placed adjacent one another in an assembled, as-used position, the hexagonal portion 326 seats within the cavity 332 and the hexagonal shape of the recess 330 is rotationally offset about the pivot axis 306 from the hexagonal shape of the portion 326. The hexagonal shape of the recess 330 can be rotationally offset from the hexagonal shape of the portion 326 by approximately 30 degrees (1/12 of a full rotation) such that the corners of the two hexagonal shapes are rotationally offset from each other as far as possible. The cylindrical cavity 332 can be large enough that the hexagonal portion 326 can be situated and freely rotate within it.

The folding knife 300, comprising the assembly 336, the second side portion 310, and the blade 304, as described above, can be assembled by sliding the opening 338 of the blade 304 over the hexagonal portion 326, second cylindrical portion 324, and first cylindrical portion 322, such that the blade 304 rests against the first side portion 308. The folding knife 300 can be further assembled by positioning the second side portion 310 so that it is rotationally offset around axis 306 from the first side portion 308 by about 30 degrees, so that the hexagonal shape of the recess 330 and the hexagonal shape of the portion 326 are generally aligned, and then sliding the recess 330 of the second side portion 310 over the hexagonal portion 326 and the second cylindrical portion 324 such that the hexagonal portion 326 rests within the cylindrical cavity 332. In this configuration, the central longitudinal axis of the washer 312, locking element 314, locking screw 316, recess 330, cavity 332, and opening 338 can all be generally aligned with the pivot axis 306.

The second side portion 310 can then be rotated until it is rotationally aligned with the first side portion 308, and such that the hexagonal shape of the recess 330 is rotationally offset from the hexagonal shape of the portion 326. In this configuration, the corners of the hexagonal portion 326 extend beyond the edges of the recess 330, thereby preventing the second side portion 310 from being removed laterally away from the assembly 336 (including the first side portion 308), and thereby also preventing the blade 304 from being removed from the knife 300. In order to remove the second side portion 310 from the assembly 336, the second side portion 310 can be rotated about 30 degrees relative to the assembly 336 such that the corners of the hexagonal portion 326 no longer capture the second side portion 310, which can then slide away from the assembly 336. Each of the components of the knife 300 can be formed of various materials, including metals, plastics, and/or composites.

Figure 11:
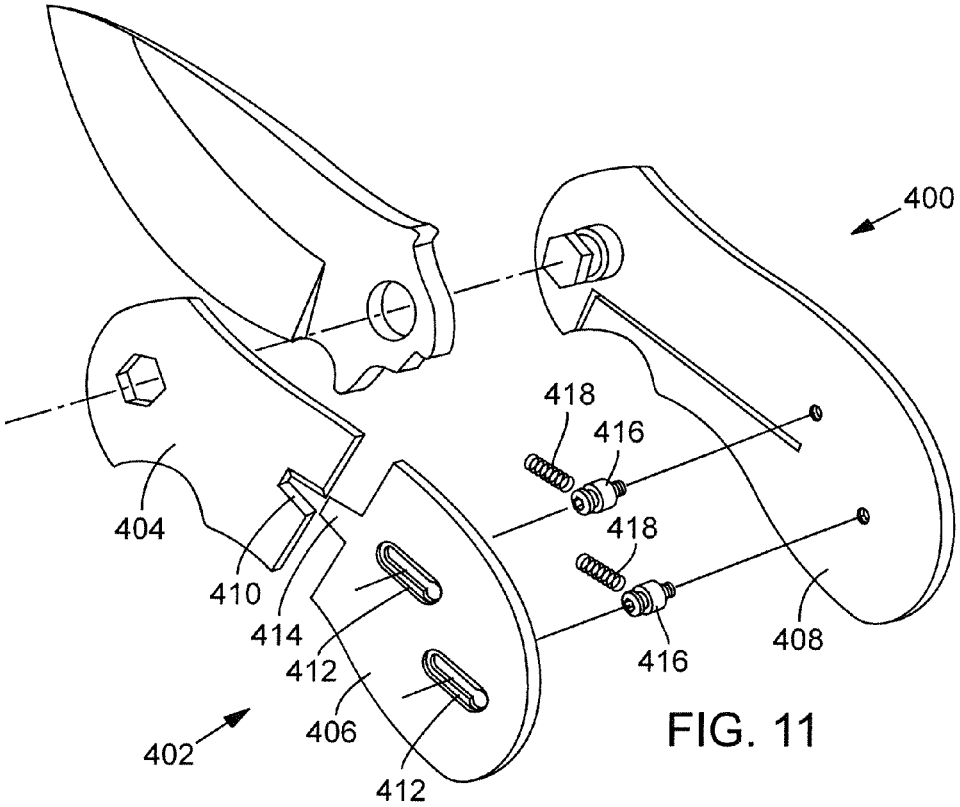
FIGS. 11-12 show a folding knife having an exemplary secondary locking mechanism.
Figure 12:
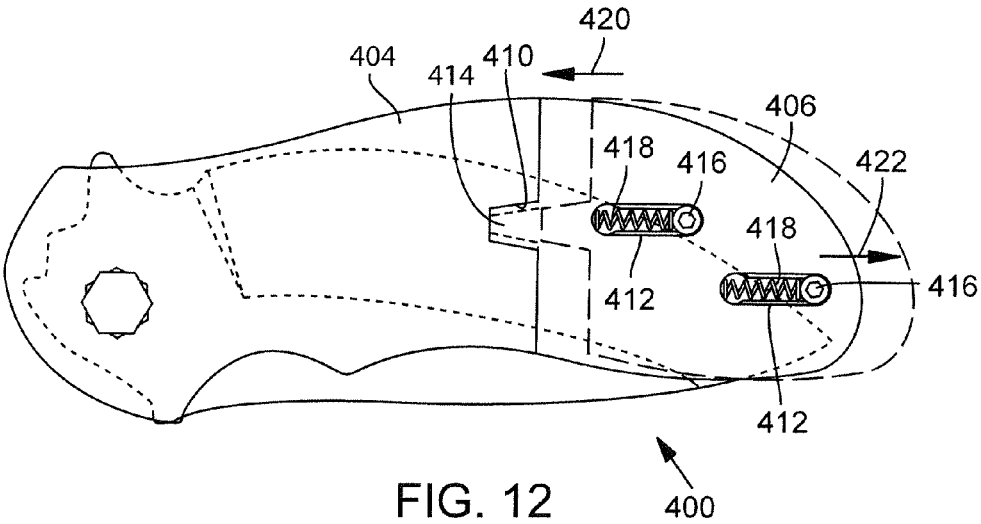

In order to further secure the two halves of the handle of a knife to one another, a secondary securing mechanism can be provided which can help to ensure that the two halves do not inadvertently rotate with respect to each other and thereby become unfastened. A variety of such mechanisms can be used, and one example is shown in FIGS. 11-12. As shown in FIGS. 11-12, a knife 400 can include a removable first side portion 402 having a distal portion 404 and a proximal portion 406, and a second side portion 408. The distal portion 404 can include a notch 410, and the proximal portion 406 can include one or more slots 412 containing springs 418 and a projection 414 configured to fit within the notch 410. The second side portion 408 can include one or more projections, or knobs, 416 configured to extend into respective slots 412. The springs 418 can be retained within the slots 412 by any of various suitable means, for example, by an external cover (not illustrated) situated over the slots 412.

The springs 418 are configured to exert a biasing force that urges the proximal portion 406 toward the distal portion 404 in the direction of arrow 420, causing the projection 414 to engage the recess 410, thereby preventing rotation of the distal portion 404 relative to the rest of the handle. The distal portion 404 can be removed by sliding the proximal portion 406 rearwardly in the direction of arrow 422 against the biasing force of the springs until the projection 414 is removed from the slot 410. The distal portion 404 can then be rotated relative to the hexagonal locking element and slid laterally away from the second side portion 408, as described in detail above.

Figure 13:
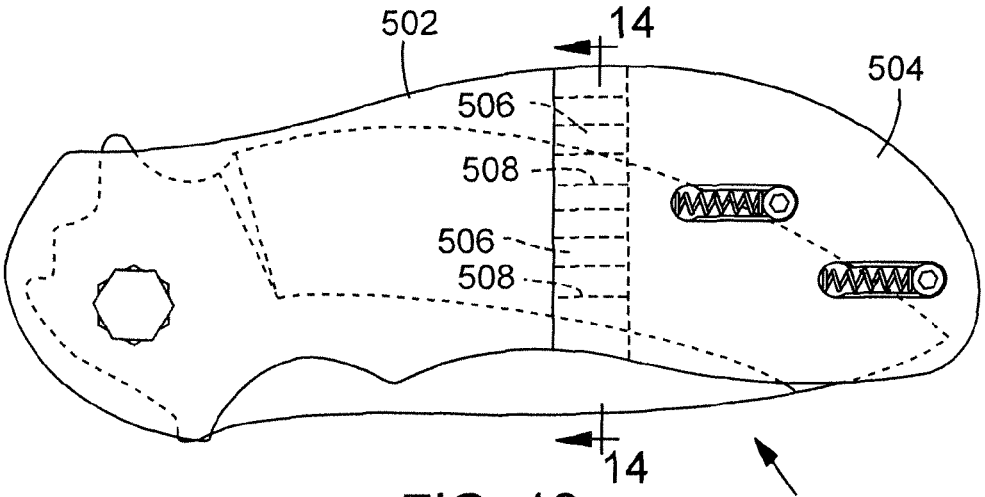
FIGS. 13-14 show a folding knife having another exemplary secondary locking mechanism.
Figure 14:
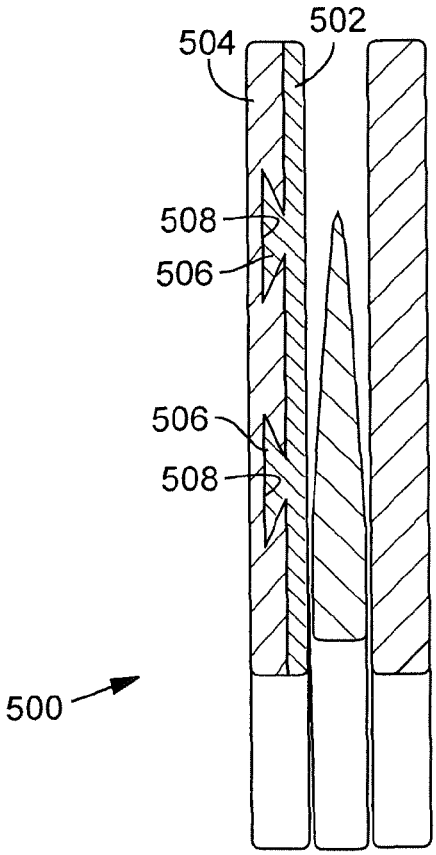

Another exemplary embodiment of a secondary securing mechanism that can be used with a knife is shown in FIGS. 13-14. FIG. 13 shows a knife 500 including a distal portion 502 and a proximal portion 504 of a first side portion of the knife 500 and FIG. 14 shows a cross sectional view of knife 500 along line 14-14 of FIG. 13. The secondary locking portion illustrated in FIGS. 13-14 is similar to that illustrated in FIGS. 11-12, except that it uses a dovetail locking system, rather than a notch and projection to rotationally lock the distal portion 502, thereby preventing the knife from becoming unfastened. For example, the distal portion 502 can include one or more dovetail-shaped projections 506 that are shaped to mate with respective one or more dovetail-shaped slots 508 of the proximal portion 504.

In another embodiment, a removable spring clip can be used to prevent rotation of the side portions of the handle relative to each other. In one implementation, a clip comprises two opposing resilient legs that can slide onto the first and second side portions 208, 210, thereby providing a clamping force against the side portions to hold them together.

FIGS. 15-19 illustrate an alternative embodiment of an easily disassembled folding knife 600. Knife 600 can include a handle 602 and a blade 604. The handle 602 can include a first side portion 606, a second side portion 608, a liner lock portion 610, and a locking portion 612. Referring to FIG. 15A, the first side portion 606 can include three engagement elements 614A-C, each having respective recesses 616 which can have flat-oval shapes (e.g., a shape comprising an oval with flat sides). Each engagement element 614 can also include respective generally circular openings 618 extending through the first side portion 606 and respective flat-oval openings 620 extending away from the respective circular openings 618 and through the first side portion 606.

The recesses 616 can be formed in a front surface 622 of the first side portion 606, which can be the exposed surface of the first side portion 606 when the knife 600 is fully assembled. Further, the flat-oval openings 620 can have a width W1 which is smaller than a width W2 (see FIG. 19) of the recesses 616, which can be about the same as the diameter of the circular openings 618, such that a lip or ledge 626 is formed in the first side portion 606. In some cases, the recesses 616 can be formed by removing material from the first side portion 606, for example, by removing between about ¼ and about ¾, or by removing about ½ of the thickness of the first side portion 606. In the illustrated embodiment, the knife 600 includes three engagement elements 614A-C, but in alternative embodiments, fewer or additional engagement elements can be used.

As shown, two of the engagement elements 614A and 614B can be located near a distal portion of the handle 602 (and thus can be called distal engagement elements) and a third engagement element 614C can be located near a proximal portion of the handle 602 (and thus can be called a proximal engagement element). Further, the flat-oval shapes of the respective components of the distal engagement elements 614A and 614B can be generally aligned with the length of the first side portion 606. That is, flat sides of the flat-oval openings 620 and the recesses 616 of the distal engagement elements 614A, 614B can be parallel or substantially parallel to the length of the first side portion 606, a top surface 628 of the first side portion 606, and/or a bottom surface 630 of the first side portion 606.

The flat-oval shapes of the respective components of the proximal engagement element 614C can be angularly offset from the length of the first side portion 606. That is, flat sides of the flat-oval opening 620 and the recess 616 of the proximal engagement element 614C can be angularly offset from the top surface 628, bottom surface 630, and/or the length of the first side portion 606, and thus from the respective flat sides of the components of the distal engagement elements 614A, 614B. The flat sides of the openings 620 of the proximal engagement elements can be offset from the flat sides of the openings 620 of the distal engagement elements by an angle $\alpha$, which can be, for example, between about 5° and about 45°.

Figure 15A:
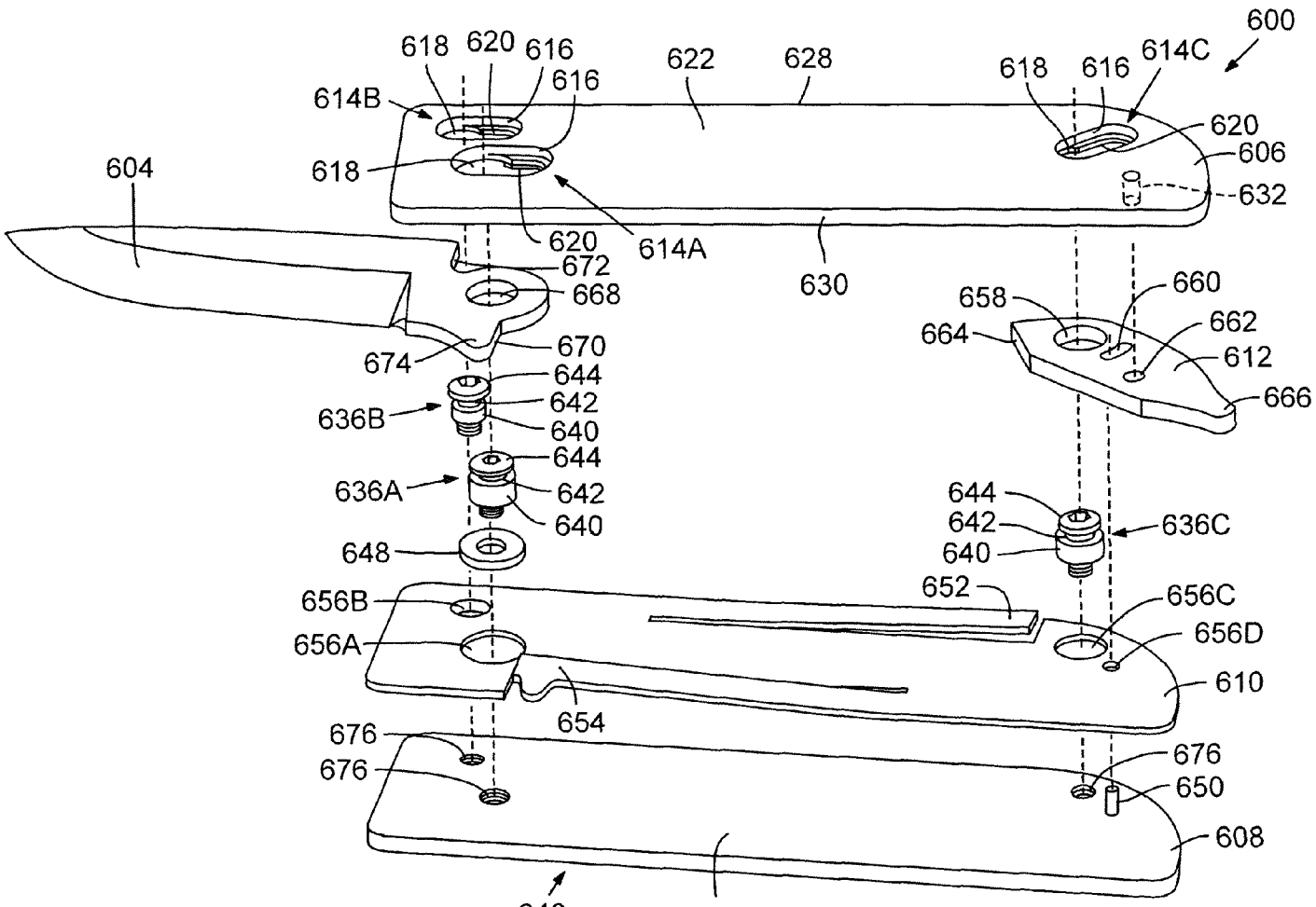
FIG. 15A shows a perspective, exploded view of another exemplary folding knife.
Figure 15B:
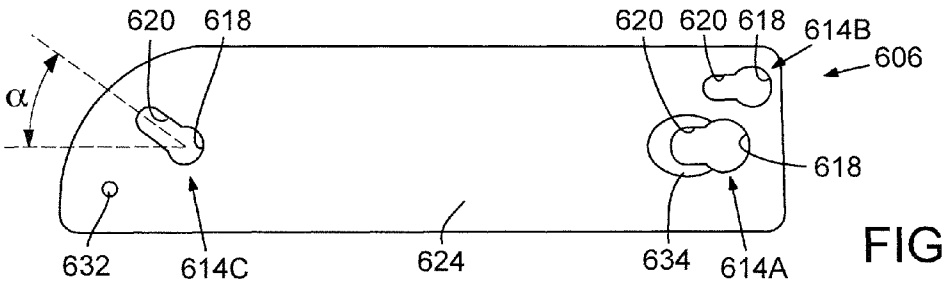
Figure 16:
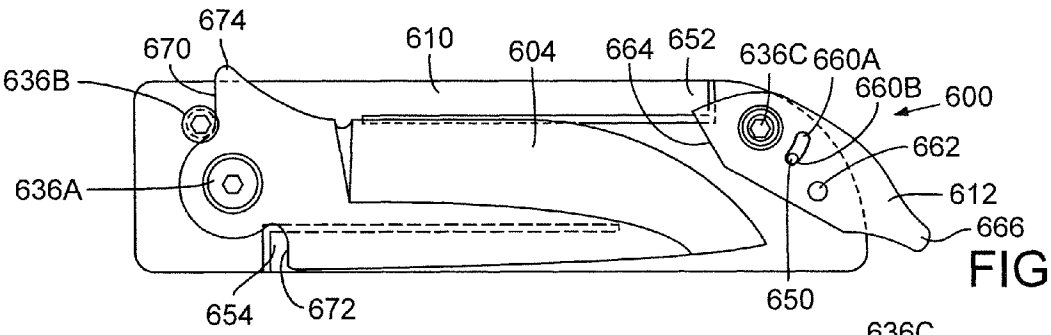
Figure 17:
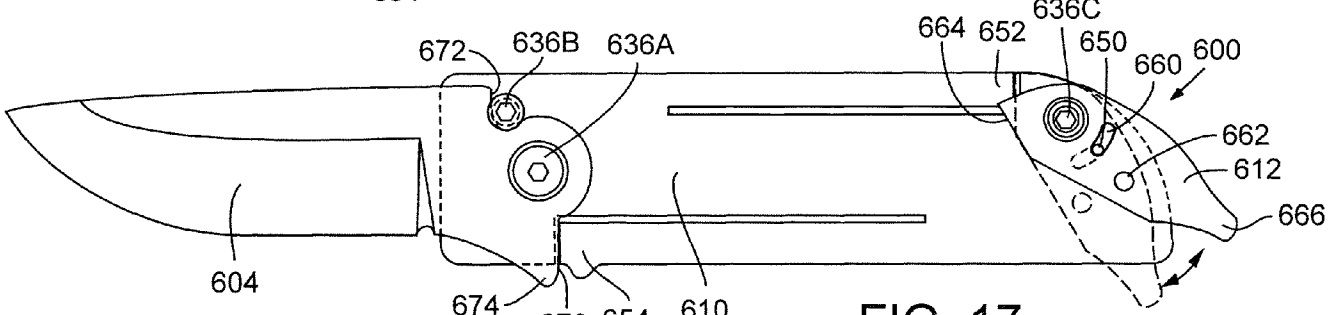

A back surface 624 (FIG. 15B) of the first side portion 606, which can be the unexposed, or internal surface of the first side portion 606 when the knife 600 is fully assembled, can include a pin 632 (FIG. 15A) and a bearing pad 634 (FIG. 15B). The pin 632 can engage with the locking portion 612 when the knife 600 is in a fully assembled configuration, as described further below. The bearing pad 634 can protrude outward from the back surface 624, in order to reduce the surface area of contact between the first side portion 606 and the blade 604 when the knife is in a fully assembled configuration, as explained further below. The bearing pad 634 can also be made of a different material than the rest of the first side portion 606, for example, a relatively lubricous metal material, to reduce friction between the blade 604 and the first side portion 606. The bearing pad 634 can have a generally semi-circular shape which surrounds the flat-oval opening 620, and partially surrounds the circular opening 618, of the engagement element 614A. In some cases, a washer can be used in place of bearing pad 634.

The second side portion 608 can have an overall shape generally matching that of the first side portion 606. As best shown in FIG. 15A, the second side portion 608 can include three engagement elements 636A-C protruding outwardly from an internal surface 638 of the second side portion 608, which can be the unexposed surface of the second side portion 608 when the knife 600 is fully assembled. Second side portion 608 can include more or fewer than three engagement elements 636, but in many embodiments, the second side portion 608 can have the same number of engagement elements 636 as first side portion 606 has engagement elements 614. The engagement elements 636 of the second side portion 608 can be configured to engage the engagement elements 614 of the first side portion 606, as further described below. The positions of the engagement elements 636 on the second side portion 608 can also be configured such that the engagement portions 636 can be aligned with respective circular openings 618 simultaneously.

Each of the engagement elements 636A-C can include a relatively wide base portion 640, a relatively narrow neck portion 642, and a relatively wide head portion 644. In the illustrated embodiment, the neck and head portions 642 and 644 can comprise portions of respective screws which can pass through the respective base portions 640 and be screwed into threaded openings 676 in a main body 646 of the second side portion 608. As shown, engagement element 636A can include a washer 648 disposed between the main body 646 of the second side portion 608 and the base portion 640 of the engagement element 636A. The washer 648 can reduce the surface area of contact between the second side portion 608 and the blade 604 when the knife 600 is in a fully assembled configuration, as explained further below. The washer 648 can also be made of a different material than the rest of the second side portion 608, for example, a relatively lubricous metal material, to reduce friction between the blade 604 and the second side portion 608. In some cases, a washer need not be a component of the engagement element 636A and can be a separate component.

As shown, the second side portion 608 can also include a pin 650 protruding outwardly from the internal surface 638 of the second side portion 608. The pin 650 can engage with the locking portion 612 when the knife 600 is in a fully assembled configuration, as described further below.

The liner lock portion 610 can have an overall shape generally matching that of the first and second side portions 606, 608, and can comprise a relatively thin piece of material, such that proximal and distal leaf springs 652, 654 can be manipulated by a user relatively easily. The liner lock portion 610 can include four openings 656A-D, which can be sized and positioned such that the liner lock portion 610 can be positioned adjacent to the second side portion 608 with the engagement elements 636A-C extending through openings 656A-C, respectively, and with the pin 650 extending through the opening 656D. When the knife 600 is in a fully assembled configuration, the distal leaf spring 654 can protect against inadvertent closing of the blade 604 after it has been opened by a user, and the proximal leaf spring 652 can prevent the locking portion 612 from accidentally moving to an unlocked position, as described further below.

The locking portion 612 can include a pivot opening 658, which can be sized to fit over the base portion 640 of the engagement element 636C such that the locking portion 612 can pivot about the engagement element 636C, for example, from a locked position when the knife is fully assembled to an unlocked position allowing the knife to be assembled or disassembled. The locking portion 612 can also include a notch 660 which can be positioned to fit over the pin 650 when the pivot opening 658 is fitted over the engagement element 636C. The notch 660 can have a shape which allows the pin 650 to move through the notch 660 as the locking portion 612 is pivoted about the engagement element 636C. For example, the notch 660 can include a first end 660A and a second end 660B such that the pin 650 is situated at the first end 660A when the knife 600 is in a fully assembled configuration (and the locking portion 612 is in a locked position, as shown in dashed lines in FIG. 17), and such that the pin 650 is situated at the second end 660B when the locking portion 612 is in an unlocked position such that the knife can be assembled or disassembled (as shown in solid lines in FIG. 17). The locking portion 612 can also include an opening 662 which can be positioned to receive the pin 632 of the first side portion, as described further below.

The locking portion 612 can further include a locking surface 664 which can be situated to engage with a proximal end portion of the proximal leaf spring 652 when the locking portion 612 is in a locked position. The locking portion 612 can also include a manipulation portion 666 extending outwardly from the rear end of the handle which can allow a user to more easily manipulate the locking portion 612 with his or her fingers.

The blade 604 can include a pivot opening 668 sized to fit over the base portion 640 of the engagement element 636A but not over the washer 648. In this manner, the engagement element 636A serves as a pivot pin or pivot element for the blade. The blade can also include a first locking surface 670 which can be situated to engage with a distal end portion of the distal leaf spring 654 when the blade 604 is in an open position, and a second locking surface 672 which can be situated to engage with the base portion 640 of the engagement element 636B when the blade is in the open position. In this way, the distal leaf spring 654 and engagement element 636B can act to prevent the blade 604 from moving with respect to the handle 602 when the blade is in an open position. Further, the blade can be configured such that the first locking surface 670 is positioned to engage with the base portion 640 of the engagement element 636B when the blade 604 is in a closed position, such that the blade 604 cannot pivot about the engagement element 636A to the extent that the blade is exposed outside the handle 602, e.g., by pivoting beyond the top surface 628. The blade 604 can also include an extension 674 which can extend outside the handle 602 when the blade 604 is in a closed position, which can allow a user to more easily manipulate and open the blade 604 with his or her fingers.

With the various components thus described, assembly and disassembly of the knife 600 will now be explained. To assemble the knife 600, the second side portion 608 (including the engagement elements 636) can be laid on a flat surface with the engagement elements 636 protruding outward from the flat surface. The liner lock portion 610 can then be laid down over the second side portion, with the engagement elements 636 extending through the respective openings in the liner lock portion 610. The locking portion 612 can then be laid down over the liner lock portion 610 with the pin 650 situated at the second end 660B of the notch 660 (that is, in the unlocked position shown in FIG. 16). The blade 604 can then be laid down over the liner lock portion such that the engagement element 636A extends through the pivot opening 668. The first side portion 606 can then be laid down over the blade 604 and the locking element 612 such that the respective head portions 644 of the engagement elements 636 extend through respective circular openings 618 of the engagement elements 614. Thus, the head portions 644 can be situated within respective recesses 616 and the neck portions 642 can be situated within respective circular openings 618.

Figure 18:
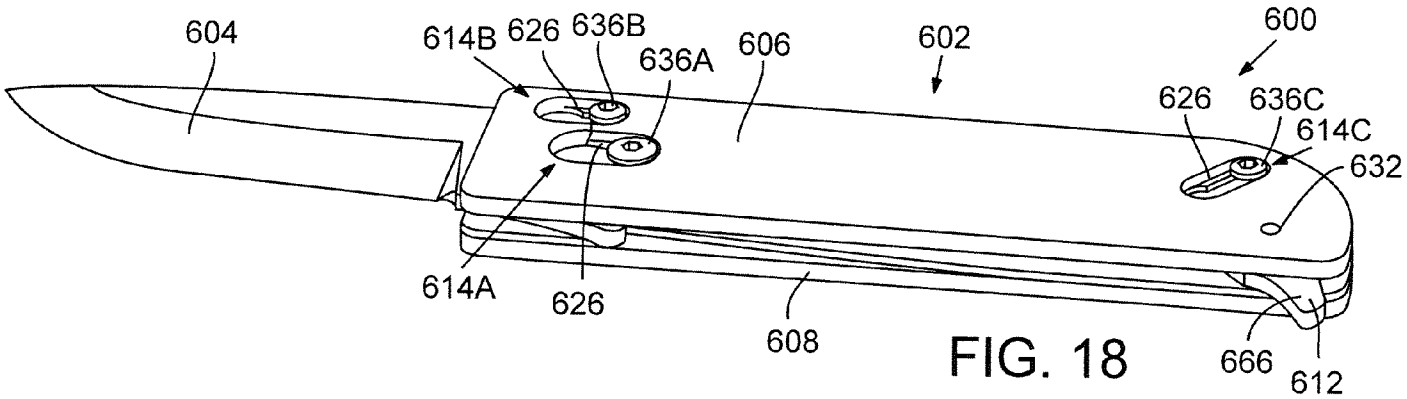
Figure 19:
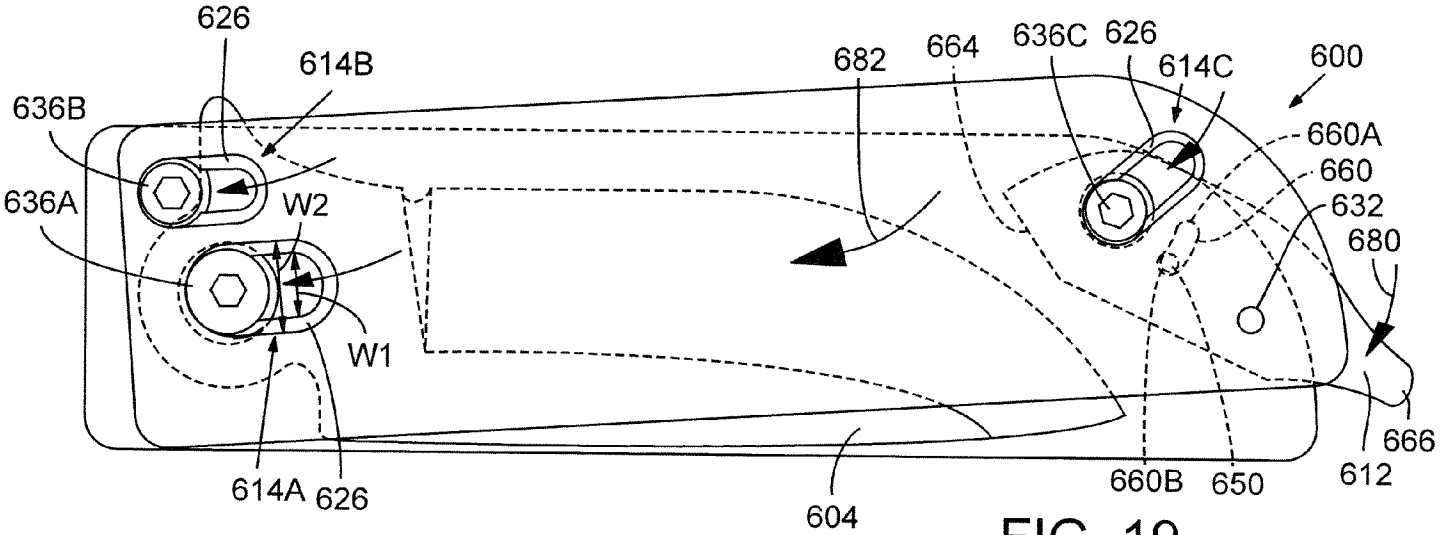
Figure 20:
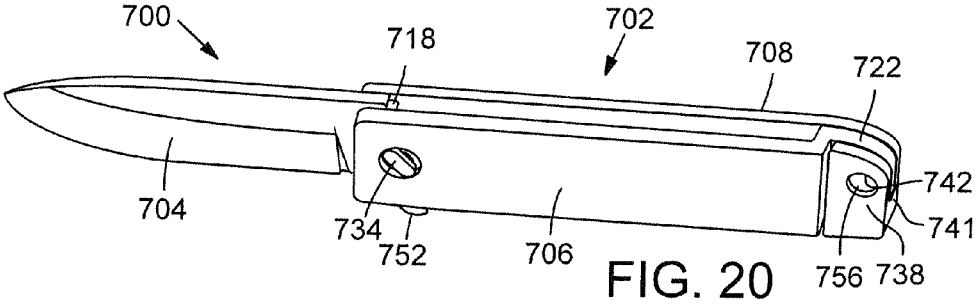
FIG. 20 shows another exemplary folding knife.

The locking portion 612 can then be pivoted about the engagement portion 636C from the open (unlocked) position to the closed (locked) position, as indicated by arrow 680 in FIG. 19. As the locking portion 612 so pivots, the engagement of the opening 662 of the locking portion 612 and the pin 632 of the first side portion 606 causes the first side portion 606 to rotate slightly about element 636A and translate distally as indicated by arrow 682 until the first side portion 606 is aligned side-by-side with the second side portion. In this position, the head portions 644 are positioned within respective recesses 616 and the neck portions 642 are positioned within respective flat-oval openings 620. Thus, the first side portion 606 is restrained against separation from the second side portion 608, as the head portions 644 are engaged with respective lips 626. When the locking portion 612 reaches the closed position, the proximal leaf spring 652 engages with the locking surface 664, restraining the locking portion from motion toward the open position, and the knife 600 is in the fully assembled configuration, as shown in FIG. 18. The blade 604 can then be pivoted to the open position, wherein it is locked open by the distal leaf spring 654. A user can manually depress the distal leaf spring 654 to close the blade 604. Each lip 626 can be a ramped surface that increases in thickness extending from the opening 618 to the end of the recess 616 opposite the opening 618. In this way, as the head portion 644 slides against the ramped lip 626, the frictional contact between the head portion 644 and the lip 626 increases and the spacing between the side portions 606, 608 decreases to hold the side portions 606, 608, the blade 604, and the liner 610 tightly in their assembled state.

To disassemble the knife 600, a user can manually depress the proximal leaf spring 652 and pivot the locking portion 612 toward the unlocked position, causing the first side portion 606 to rotate and translate proximally until the neck portions 642 of the engagement elements 636 are situated within the circular openings 616, at which point the various components can then be removed from one another laterally.

FIGS. 20-23 illustrate an alternative embodiment of an easily disassembled folding knife 700. Knife 700 can include a handle 702 and a blade 704. The handle 702 can include a first side portion 706, a second side portion 708, and a locking button 744. The first side portion 706 can include a main body 710, a circular recess 712 formed in an outer surface 714 (i.e., an exposed surface when the knife 700 is fully assembled) of the main body 710, and a flat-oval shaped opening 716 extending from the recess 712 through the main body 710 to form a lip or ledge 717. The first side portion 706 can also include a protruding pin 718 extending from an inner surface 720 (FIG. 23) of the main body 710. The recess 712, opening 716, and pin 718 can be located at a distal portion of the first side portion 706. A proximal portion of the handle 706 can include a locking portion 722 which is offset from the main body 710 in the direction of the inner surface 720, such as by an intermediate offsetting element 723. The locking portion 722 can include a circular locking recess 724.

The second side portion 708 can include a main body 726, an engagement element 728 comprising a relatively wide base portion 730, relatively narrow neck portion 732, and a relatively wide head portion 734 having a flat-oval shape matching that of (but being slightly smaller than) the flat-oval opening 716 of the first side portion 706. The second side portion 708 can also include a semi-circular groove 736 positioned partially around the engagement element 728. The second side portion 708 can also include a locking portion 738 which is offset from the main body 726 in the direction of an inner surface 740 (FIG. 23) of the main body 726, such as by an intermediate offsetting element 741. The locking portion 738 can include a circular locking opening 742.

The blade 704 can include a circular opening 746 sized to fit over the engagement element 728, a first locking surface 748 situated to engage the pin 718 when the knife 700 is in a fully assembled configuration and the blade 704 is in a closed position, and a second locking surface 750 situated to engage the pin 718 when the knife is in a fully assembled configuration and the blade 704 is in an open position. The blade 704 can also have a shape including an extension 752 which extends from the fully assembled knife 700 when the blade is in both the open and the closed positions, in order to assist a user in opening and/or closing the blade. The locking button 744 can include a relatively wide base 754, relatively narrow head 756, and a spring 758 disposed in recess 724 and extending away from the base 754 in a direction away from the head 756.

Figure 21:
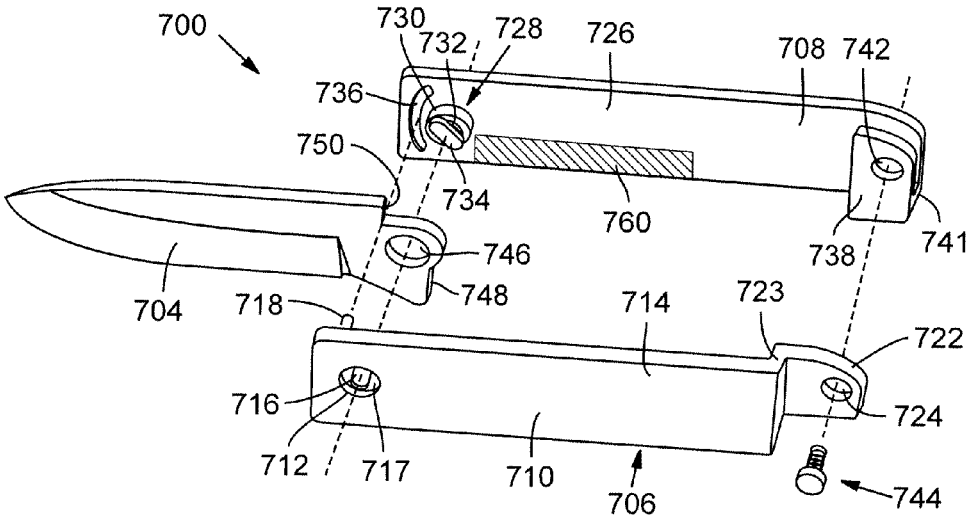
FIG. 21 shows a perspective, exploded view of the folding knife of FIG. 20.

As shown in FIG. 21, the knife 700 can also include a sharpening element 760 coupled to, for example, the inner surface 740 of the second side portion 708. The sharpening element can include, as examples, a sharpening steel element, or a diamond sharpening element or any suitably abrasive surface to allow a user to sharpen a blade (e.g., blade 704) thereon. Any of the knives described herein can include such a sharpening element, e.g., to facilitate sharpening of the blade in the field. Advantageously, this eliminates the need to carry a separate sharpener for sharpening the blade of the knife. If the blade 704 needs sharpening, the knife can easily be disassembled, preferably without the use of any tools and the blade can be sharpened on the sharpening surface 760 of the handle portion 708. In other embodiments, element 760 can be a removable sharpening element that can be removed from handle portion 708 for use.

Figure 22:
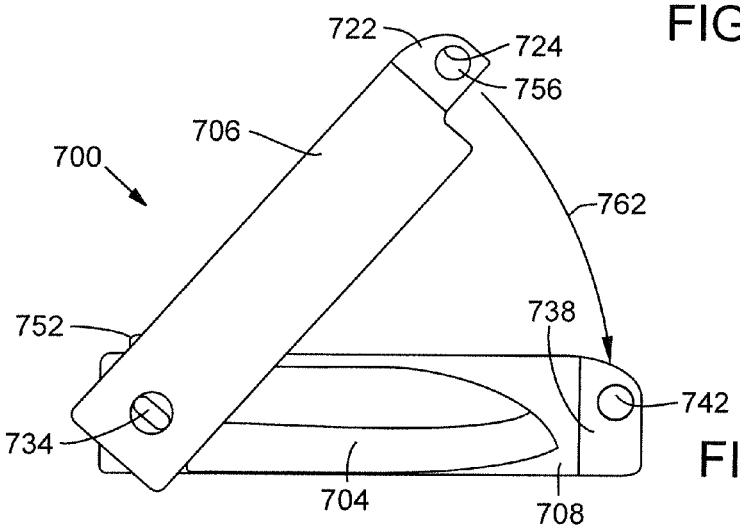
FIG. 22 shows a partially assembled view of the folding knife of FIG. 20.

To assemble the knife 700, the opening 746 of the blade can be positioned over the engagement element 728 of the second side portion 708. The flat-oval opening 716 of the first side portion 706 can then be aligned with the flat-oval head portion 734 of the second side portion 708, and the first side portion can be laid over the second side portion such that the head portion 734 is situated within the recess 712, the neck portion 732 is situated within the opening 716, and the pin 718 is situated within the groove 736, as shown in FIG. 22. The button 744 can then be situated such that the spring 758 fits within the circular recess 724. By depressing the button into the recess 724 (e.g., by manually pressing the button 744 to compress the spring 758) and rotating the first side portion 706 such that the locking portion 722 moves toward the locking portion 738 (and the pin 718 moves within the groove 736), as indicated by arrow 762 in FIG. 22, the first side portion 706 can be locked to the second side portion 708. That is, first side portion 706 is restrained against motion away from the second side portion by the engagement of the head portion 734 with the lip 717 and by the engagement of the locking portion 738 with the locking portion 722.

Figure 23:
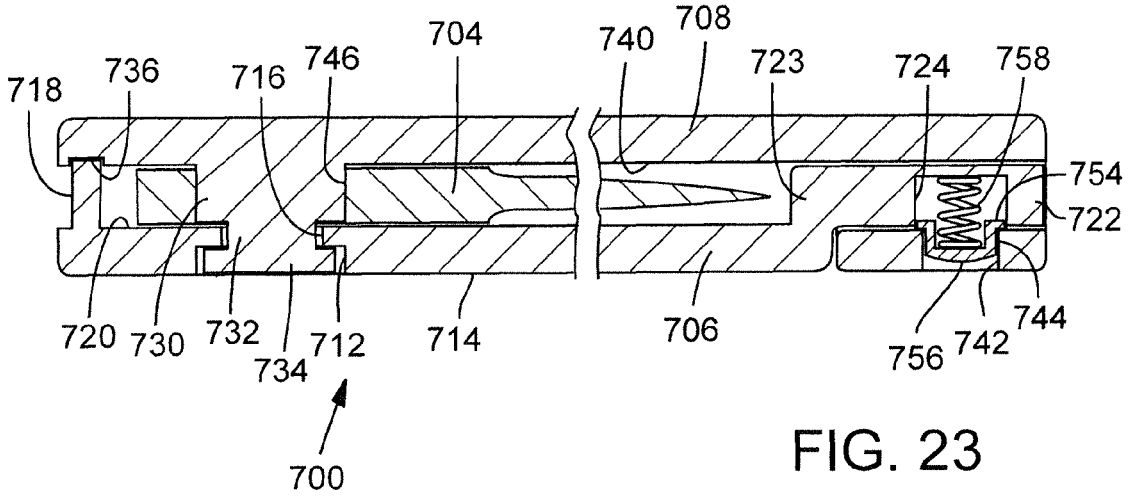
FIG. 23 shows a bottom cross-sectional view of a portion of the folding knife of FIG. 20.

Further, by rotating the first side portion until the button 744 is aligned with the circular locking opening 742, the button can be urged into engagement with the opening 742 by the spring 758, such that the head 756 is positioned within the opening 742, and the base 754 is positioned within the recess 724, as shown in FIG. 23, thereby preventing any further relative rotation between the side portions 706, 708. To disassemble the knife 700, the button can then be depressed (e.g., manually) until its head 756 is no longer situated within the opening 742, the first side portion 706 can be rotated to separate the locking portions 722, 738 and align the head portion 734 with the opening 718, and the components can then be removed from one another laterally. In some cases, the knife 700 incorporates washers or similar components, as described above, e.g., with respect to knife 600. In some cases, the knife 700 incorporates a liner lock or other similar component, as described above, e.g., with respect to knife 600. In some embodiments, the base 754 of the button 744 can be configured to be retained within the recess 724 when the first side portion 706 is separated from the second side portion 708.

FIGS. 24-28 illustrate an alternative embodiment of an easily disassembled folding knife 800. Knife 800 can include a handle 802 and a blade 804. The handle 802 can include a first side portion 806 and a second side portion 808. The first side portion 806 can include a main body 810, two circular recesses 812, 814 formed in an outer surface (i.e., an exposed surface when the knife 800 is fully assembled) of the main body 810, and two respective flat-oval shaped openings 818, 820 extending from the recesses 812, 814 through the main body 810 to form respective lips or ledges 822, 824. The first side portion 806 can also include a protruding pin 826 extending from an inner surface of the main body 810. The recess 812, opening 818, and pin 826 can be located at a distal portion of the first side portion 806, while the recess 814 and opening 820 can be located at a proximal portion of the first side portion 806.

The second side portion 808 can include a main body 830, an engagement element 832 comprising a relatively wide base portion 834, relatively narrow neck portion 836, and a relatively wide head portion 838 having a flat-oval shape matching that of (but being slightly smaller than) the flat-oval opening 818 of the first side portion 806. The second side portion 808 can also include a divot 864 which can receive an end of the pin 826 when the knife 800 is fully assembled. The second side portion 808 can also include a locking portion 840 which includes an actuating arm 842 and a retaining element 843 mounted to the arm 842. The retaining element 843 comprises a relatively narrow neck portion 844 and a relatively wide head portion 846 having a flat-oval shape matching that (but being slightly smaller than) the flat-oval opening 820 of the first side portion 806. The actuating arm 842 and retaining element 843 can be coupled to one another such that rotation of the arm 842 causes rotation of the retaining element 843. The second side portion 808 can also include a pair of pins 848 which can prevent the actuating arm 842 from being rotated too far into the handle 802 when the knife 800 is fully assembled.

Figure 24:
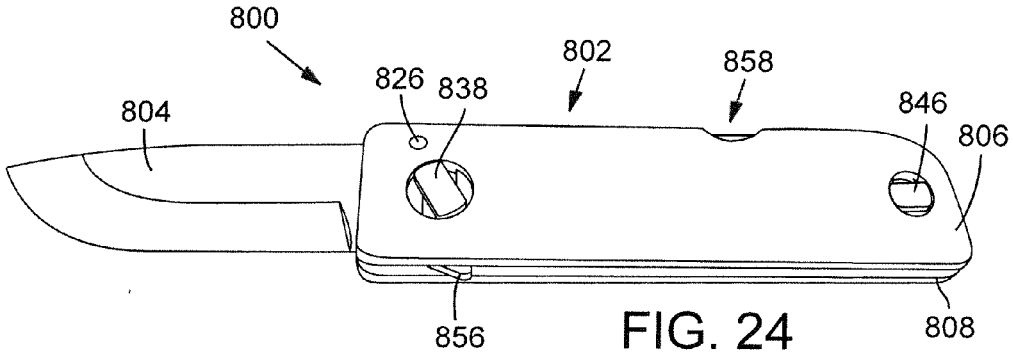
FIG. 24 shows another exemplary folding knife.

As shown, the flat-oval openings 818, 820 of the first side portion 806 can be oriented in the same direction. That is, the flat sides of the flat-oval openings 818, 820, can be generally parallel to one another. As also shown, the flat-oval head portion 838 can be oriented such that the flat sides of the head portion 838 are offset angularly from the flat sides of the opening 818 when the knife 800 is fully assembled, as shown in FIG. 24. Further, the head portion 846 of retaining element 843 can be oriented such that the flat sides of the head portion 846 are offset angularly from the flat sides of the opening 820 when the knife 800 is fully assembled (as shown, they are offset by about 90° when the knife 800 is fully assembled, but various angular offsets are suitable).

The first and second side portions 806, 808, of the knife 800 can include divots 858 and the actuating arm 842 can include gripping elements 860 (e.g., a nail-nick) aligned with the divots 858, in order to further facilitate the manual operation (e.g., rotation) of the actuation arm 842. The blade 804 can include a circular opening 850 sized to fit over the engagement element 832, a first locking surface 852 situated to engage the pin 826 when the knife 800 is in a fully assembled configuration and the blade 804 is in a closed position, and a second locking surface 854 situated to engage the pin 826 when the knife is in a fully assembled configuration and the blade 804 is in an open position. The blade 804 can also have a shape including an extension 856 which extends from the fully assembled knife 800 when the blade is in both the open and the closed positions, in order to assist a user in opening and/or closing the blade.

Figure 25:
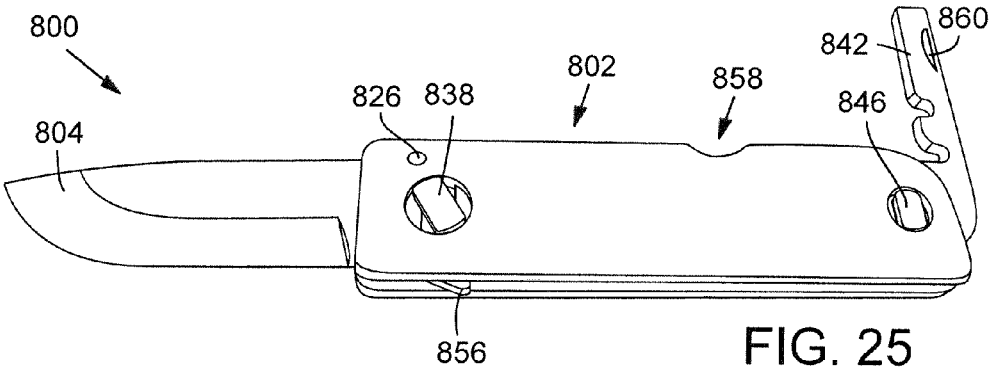
FIG. 25 shows a partially assembled view of the folding knife of FIG. 24.
Figure 26:
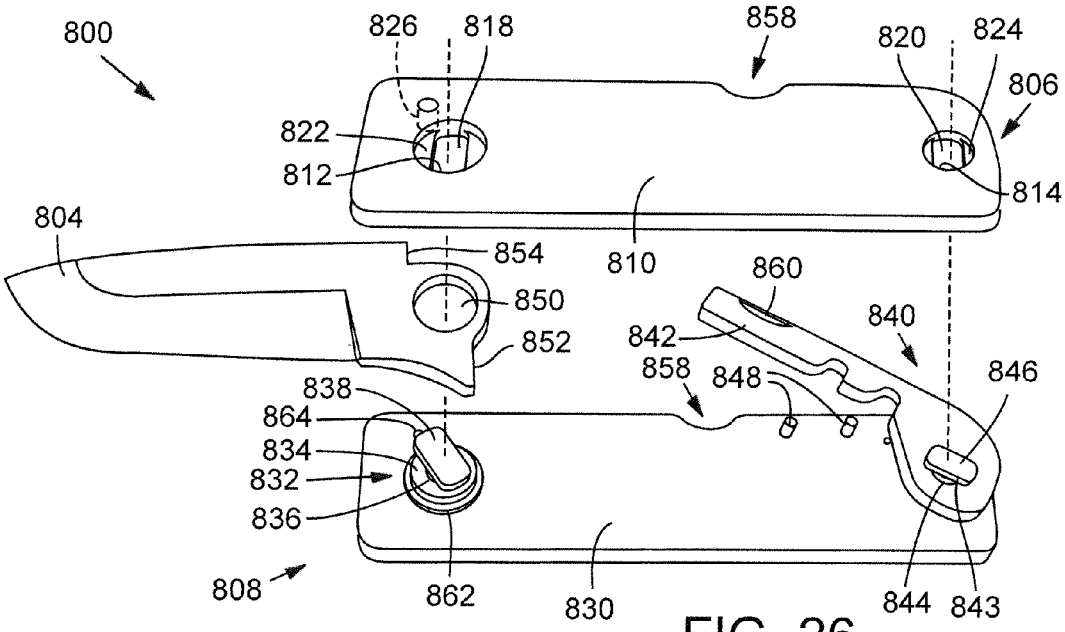
FIG. 26 shows a perspective, exploded view of the folding knife of FIG. 24.
Figure 27:
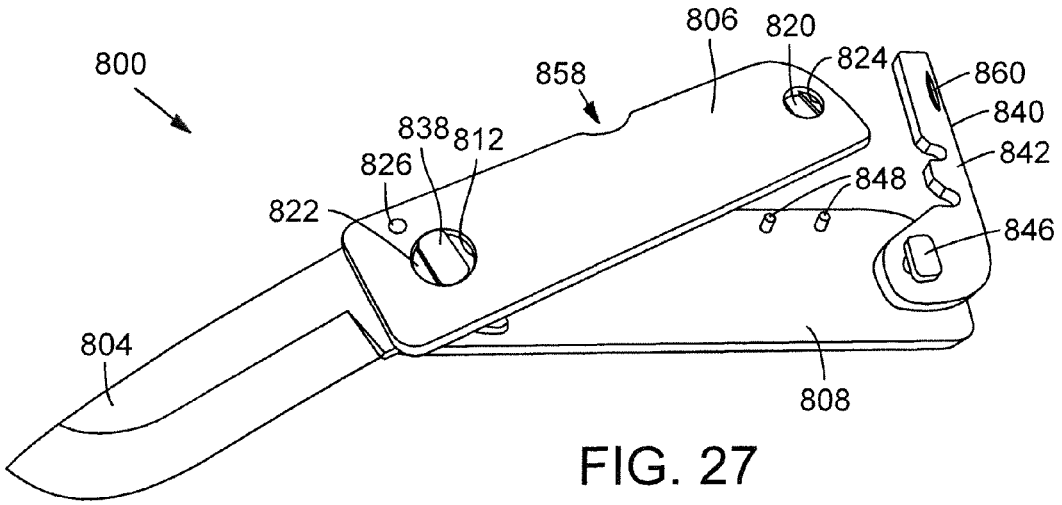
FIGS. 27-28 each show a partially assembled view of the folding knife of FIG. 24.
Figure 28:
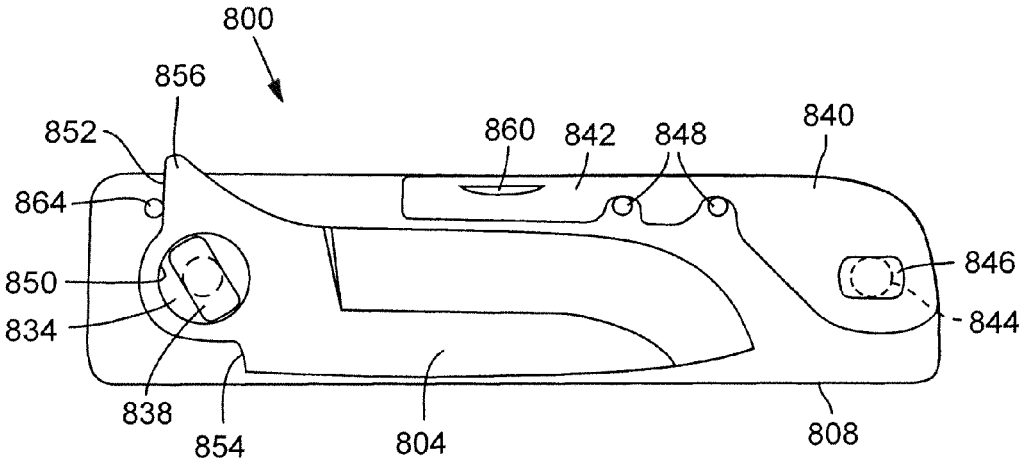
Figure 29:
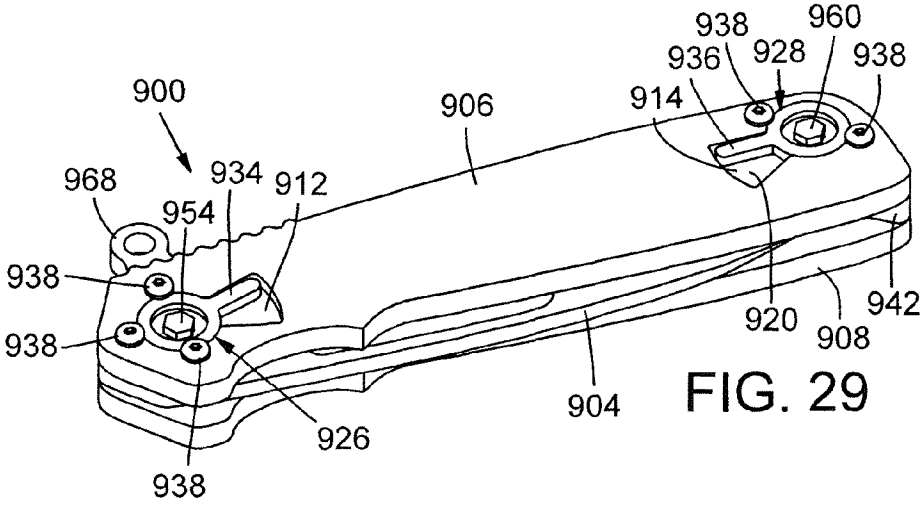
FIG. 29 shows another exemplary folding knife in a closed configuration.
Figure 30:
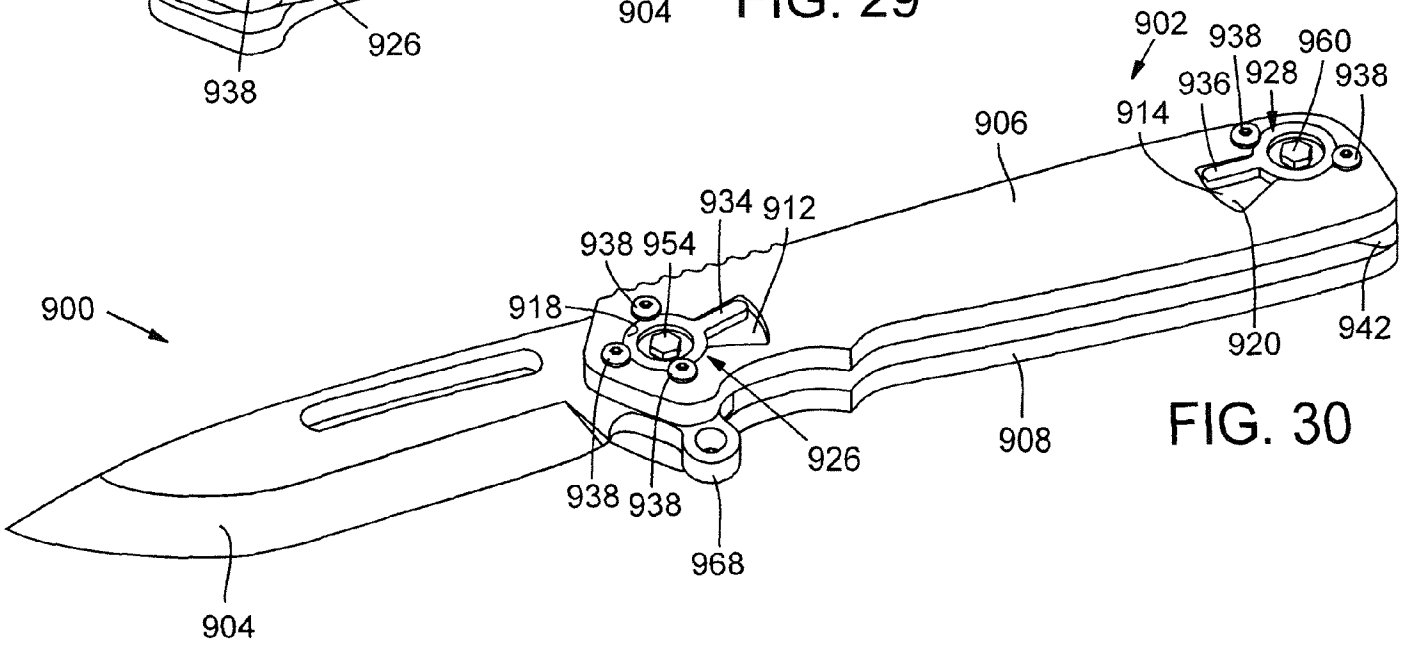
FIG. 30 shows the folding knife of FIG. 29 in an open configuration.
Figure 32:
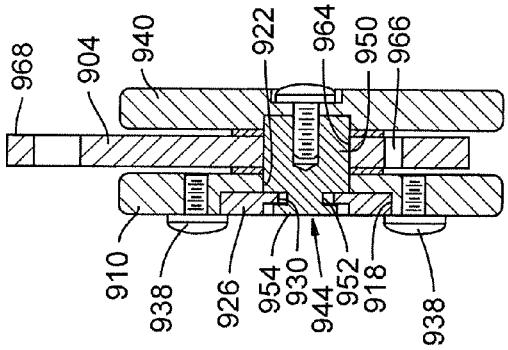
FIGS. 31-34 show various components of the folding knife of FIG. 30.
Figure 31:
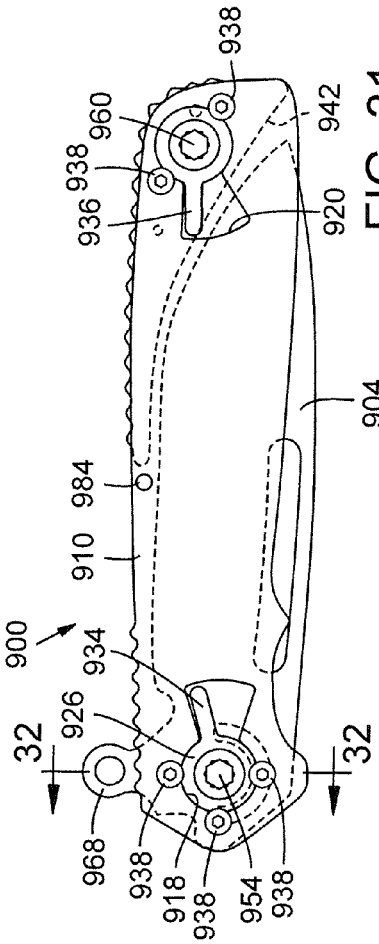
Figure 33:
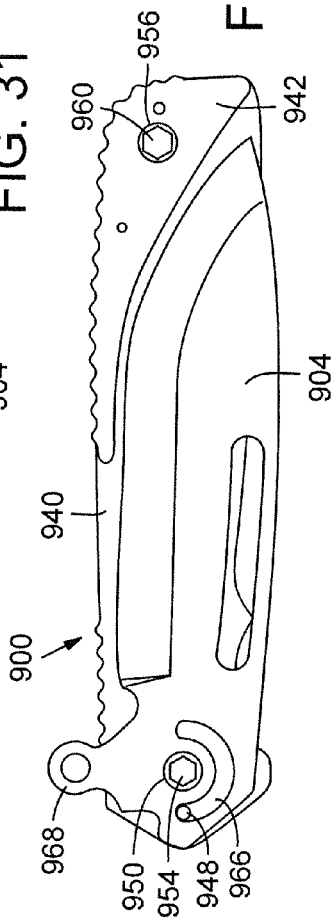
Figure 34:
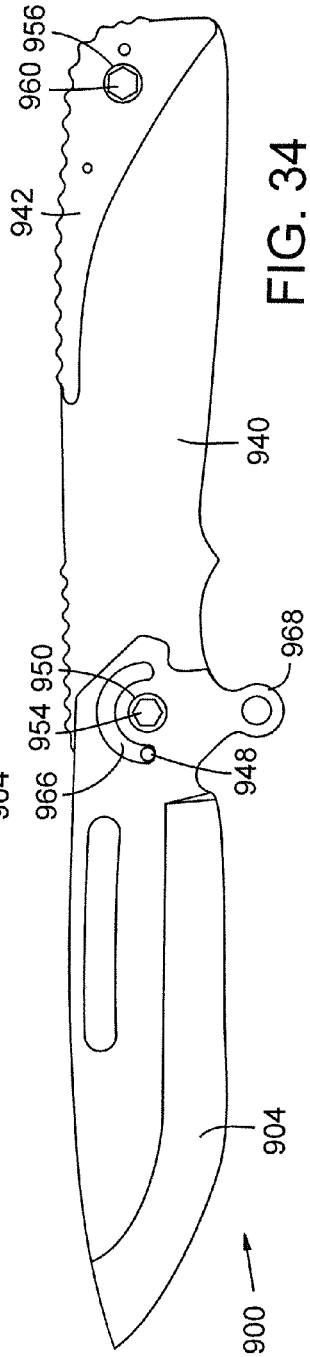

To assemble the knife 800, the opening 850 of the blade can be positioned over the engagement element 832 of the second side portion 808, as shown in FIG. 28. The flat-oval opening 818 of the first side portion 806 can then be aligned with the flat-oval head portion 838 of the second side portion 808, and the first side portion 806 can be laid over the second side portion such that the head portion 838 is situated within the recess 812, and the neck portion 836 is situated within the opening 818, as shown in FIG. 27. The locking portion 840 can then be rotated such that the opening 820 will be aligned with the head portion 846 when the first side portion 806 is rotated to bring the opening 820 to the head portion 846. The first side portion 806 can then be rotated about engagement element 832 such that the opening 820 moves toward the locking portion 840 and head portion 846. Once the first side portion 806 has been rotated so the opening 820 overlays the head portion 846, the opening 820 can be seated on the locking portion 840 such that the neck 844 is situated within the opening 820 and the head 846 is situated within the recess 814, as shown in FIG. 25. The locking portion 840 can then be rotated such that the head 846 is no longer aligned with the opening 820, such as by manual operation (e.g., rotation) of the actuating arm 842 to the closed or locked position shown in FIG. 24. The first side portion 806 thus can be restrained against motion away from the second side portion 808 by the engagement of the head portion 838 by the lip 822 and by the engagement of the head 846 by the lip 824.

To disassemble the knife 800, the locking portion 840 can be rotated to the open or unlocked position to align the head 846 with the opening 820. The first side portion 806 can then be lifted off the locking portion 840 and rotated to align the opening 818 with the head portion 838. The components of the knife 800 can then be removed from one another laterally. In some cases, the knife 800 incorporates washers 862 or similar components, as described above, e.g., with respect to knife 600. In some cases, the knife 800 incorporates a liner lock or other similar component, as described above, e.g., with respect to knife 600. In addition, one or both of lips 822, 824 can comprise a ramped surface with increasing thickness that contacts a respective head portion 838, 846. As the side portion 806 is rotated from the position shown in FIG. 27 to the position shown in FIG. 24, frictional contact between the ramped surface and the respective head portion increases and the lateral spacing between the side portions 806, 808 decreases, thereby tightly holding the side portions 806, 808, and the blade 804 together in the assembled state.

Figure 35:
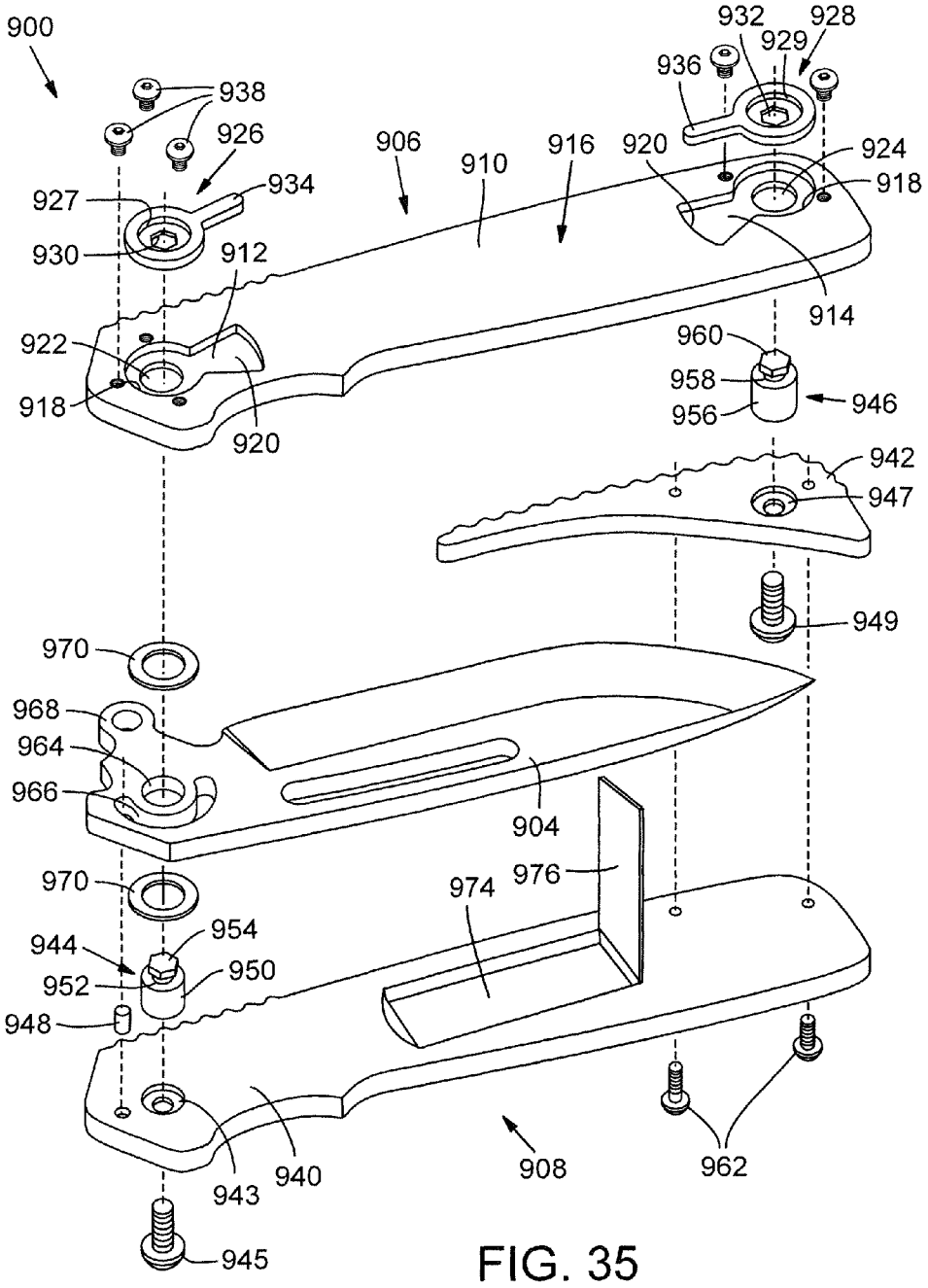
FIG. 35 shows a perspective, exploded view of the folding knife of FIG. 30.

FIGS. 29-35 illustrate an alternative embodiment of an easily disassembled folding knife 900. Knife 900 can include a handle 902 and a blade 904. The handle 902 can include a first side portion 906 and a second side portion 908. The first side portion 906 can include a main body 910 and two recesses 912, 914 formed in an outer surface 916 (i.e., an exposed surface when the knife 900 is fully assembled) of the main body 910. As best shown in FIG. 35, the recesses 912, 914 can each have shapes resembling the shape of a keyhole, or include a circle-shaped portion 918 with a fan-shaped portion 920 extending away from the circle-shaped portion 918. The first side portion 906 can further include two circular openings 922, 924 extending from the centers of respective circle-shaped portions 918 through the main body 910.

The first side portion 906 can also include two rotatable locking or retaining elements, or locks 926, 928 situated within respective recesses 912, 914. The locks 926, 928 can have shapes comprising circles with circular recesses 927, 929 at their centers and hexagonal openings 930, 932 at the centers of the circular recesses 927, 929. The locks can also have respective actuators or levers 934, 936 extending away from the circle-shaped portions. The actuators 934, 936 can be positioned within the respective fan-shaped portions 920 of the recesses 912, 914 such that a user can move the actuator from one side of the fan-shaped portion 920 to the other side of the fan-shaped portion 920 to cause the hexagonal openings 930, 932 to rotate. The first side portion 906 can also include several screws 938 screwed into the main body 910 such that the heads of the screws overlap the recesses 912, 914, and locks 926, 928, to retain the locks 926, 928 within the recesses 912, 914.

The second side portion 908 can include a main body 940, a spacer 942, a distal engagement portion 944, a proximal engagement portion 946, and a pin 948. The distal engagement portion 944 can include a relatively wide base portion 950, a relatively narrow neck portion 952, and a relatively wide head 954. The proximal engagement portion 946 can similarly include a relatively wide base portion 956, a relatively narrow neck 958, and a relatively wide head 960. The heads 954, 960 can have shapes matching that of, but being slightly smaller than, the hexagonal openings 930, 932. In some cases, the rotatable locks 926, 928 can be fabricated from the same material (e.g., steel) as the heads 954, 960 so that the head portions 954, 960 can easily slide through the hexagonal openings 930, 932 in the locks 926, 928.

The spacer 942 can be coupled to the main body 940, for example by an adhesive, by screws 962 as shown, or by various other suitable means. The distal engagement portion 944 can be seated within a recess 943 in the main body 940 and coupled thereto by a screw 945, or by various other suitable means. The proximal engagement portion 946 can be seated within a recess 947 in the spacer 942 and coupled thereto by a screw 949, or by various other suitable means. The pin 948 can be situated to engage the blade (described below) to prevent it from pivoting farther than desired.

The blade 904 can include a circular opening 964 sized to fit over the distal engagement portion 944 and a semi-circular slot 966 positioned with respect to the opening 964 to fit over the pin 948 when the opening 964 is fitted over the engagement portion 944. The blade 904 can also include an extension 968 which can extend free of the handle 902 when the knife 900 is fully assembled and the blade is in either an open or a closed position, in order to assist a user in opening and/or closing the blade 904.

As shown in FIG. 35, the knife 900 can also include a recessed compartment 974 housed within the second side portion 908. The compartment 974 can allow a user of the knife 900 to store various items in the handle 906 of the knife 900, for example, other blades or tools, flint and steel, blade sharpeners, matches, medication, or any other sufficiently small items the user may want to have available in the field. Any of the knives described herein can include such an internal compartment, e.g., to facilitate storage and concealing of small items in the field. The recessed compartment 974 can be covered by a lid 976, which can be pivotally connected to the inside surface of the handle portion 908.

To assemble the knife 900, the opening 964 of the blade 904 can be positioned over the engagement element 944 such that the pin 948 is positioned within the slot 966. The locks 926, 928 can then be actuated such that the hexagonal openings 930, 932 are generally aligned with the heads 954, 960. The first side portion 906 can then be laid down on the second side portion 908 such that the engagement portions 944, 946 extend through the openings 922, 924, 930, 932 such that the necks 952, 958 are situated within the hexagonal openings 930, 932, and such that the heads 954, 960 are situated within the circular recesses 927, 929. The locks 926, 928 can then be actuated (pivoted) such that the hexagonal openings 930, 932 are no longer aligned with the heads 954, 960, thereby locking the first side portion 906 to the second side portion 908, in a manner similar to that described above. In some cases, the head portions 954, 960 can comprise a ramped surface with variable thickness that contacts the respective locks 926, 928, and the surfaces of the locks 926, 928 which contact the head portions 954, 960, can comprise complementarily ramped surfaces with variable thickness. Thus, as the locks 926, 928 are rotated from an unlocked to a locked position, frictional contact between the head portions 954, 960, and the locks 926, 928 increases and the lateral spacing between the side portions 906, 908 decreases, thereby tightly holding the side portions and the blade together in the assembled state.

To disassemble the knife 900, the locks 926, 928 can be actuated such that the hexagonal openings 930, 932 are aligned with the heads 954, 960, and the components of the knife 900 can then be removed from one another laterally. In some cases, the knife 900 incorporates washers 970 or similar components, as described above, e.g., with respect to knife 600. In some cases, the knife 900 incorporates a liner lock or other similar component, as described above, e.g., with respect to knife 600.

Figure 36:
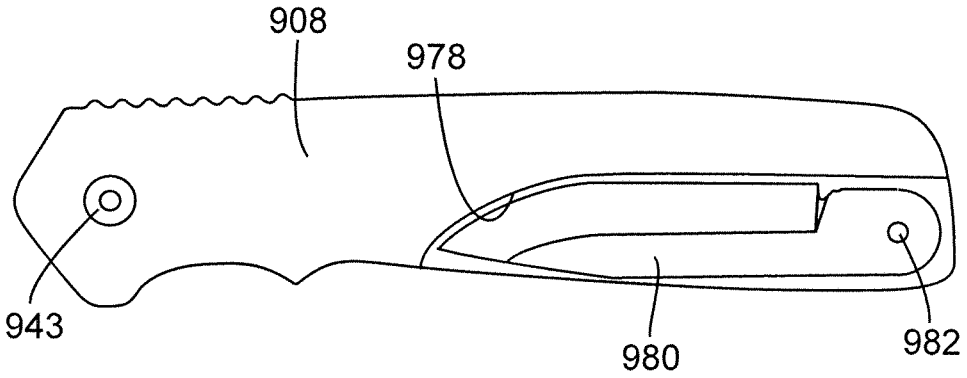
FIG. 36 shows one embodiment of a side portion of the knife of FIG. 30

FIG. 36 shows one embodiment of the second side portion 908 including a recess 978 formed in the second side portion 908 and a secondary tool element 980 pivotally coupled to the second side portion 908 by pivot element 982. In particular embodiments, the recess 978 can be formed on the inside surface of the side portion 908, although it can be formed on the outside surface of the side portion 908 in other embodiments. In this embodiment of the second side portion 908, the secondary tool 980 can pivot with respect to the second side portion from a closed position, in which the tool 980 is situated within the recess 978, and an open position, in which the tool 980 can be used. Thus, when a user is using the blade 904 of the knife 900, or when a user is not using the knife 900, the secondary tool 980 can be hidden within the knife 900. When a user desires to use the secondary tool 980, the tool 980 can be pivoted about element 982 to an open position for use. If desired, the side portion 908 can be removed from the knife, and the side portion 908 and tool element 980 can be used as a separate tool. In various embodiments, the tool 980 can comprise a blade, a screwdriver, a can opener, a sharpener for sharpening the blade 904, a nail file, or any other suitable tool known in the art.

In any of the embodiments described herein, any of various mechanisms can be used to lock the blade of a folding knife in the open and the closed positions, and a thumbstud can be used to stop the rotation of the blade when received in the handle. Further, in any of the embodiments described herein, a knife can include one or more dowels or thumb-actuated screws 984 (FIG. 31) each of which extends through one side portion 906 and is tightened into a threaded opening in the other side portion 908. The screw 984 allows a user to tighten the first and second side portions of a handle laterally toward one another using manual pressure without the use of tools. Further, in any of the embodiments described herein, a bearing system such as is described in U.S. Pat. App. Pub. No. 2012/0234142 can be incorporated into the knife in order to reduce friction forces exerted against the blade of the knife, for example, as the blade is opened or as the blade is closed. In any of the embodiments described herein, a knife can be provided in a kit with a plurality of blades or other tools. Because the folding knives described herein are more readily disassembled and reassembled than other known knives, any of the blades in the kit can easily be installed in the knife, depending on the particular functionality desired. In any of the embodiments described herein, a knife can be provided with a clip secured to the handle portion so that the knife can be clipped onto, for example, a user's belt or pocket.

Further still, except where structurally impossible, any of the features described herein can be used in combination with any other feature described herein. For example, a folding knife can include a first side portion having locking elements formed integrally, such as in knife 200, and a second side portion having a recess and cavity for receiving the locking elements, such as in knife 300. Similarly, a folding knife can include a first side portion and structurally distinct locking elements which together can form an assembly, such as in knife 300, and a second side portion having an opening extending therethrough, such as in knife 200. In another embodiment, a folding knife can comprise the locking portion 840 of the embodiment of FIGS. 24-28 to retain the rear ends of handle side portions together and the locking element 926 of the embodiment of FIGS. 29-35 to retain the forward ends of the handle side portions together.

The embodiments disclosed herein provide advantages over prior folding knives, including prior folding knives having removable blades. For example, some of the knives disclosed herein have a simple construction which can increase reliability of the knife and simplify the process of removing or replacing a blade. In the illustrated embodiments, the handle can be disassembled and the blade can be removed or replaced by hand, without using any tools, and preferably without removing any small parts, thereby reducing or eliminating the chance of losing a part of the knife.

For purposes of this description, certain aspects, advantages, and novel features of the embodiments of this disclosure are described herein. The disclosed methods, apparatuses, and systems should not be construed as limiting in any way. Instead, the present disclosure is directed toward all novel and nonobvious features and aspects of the various disclosed embodiments, alone and in various combinations and sub-combinations with one another. The methods, apparatuses, and systems are not limited to any specific aspect or feature or combination thereof, nor do the disclosed embodiments require that any one or more specific advantages be present or problems be solved.

Although the operations of some of the disclosed methods are described in a particular, sequential order for convenient presentation, it should be understood that this manner of description encompasses rearrangement, unless a particular ordering is required by specific language. For example, operations described sequentially may in some cases be rearranged or performed concurrently. Moreover, for the sake of simplicity, the attached figures may not show the various ways in which the disclosed methods can be used in conjunction with other methods. As used herein, the terms "a", "an" and "at least one" encompass one or more of the specified element. That is, if two of a particular element are present, one of these elements is also present and thus "an" element is present. The terms "a plurality of" and "plural" mean two or more of the specified element.

As used herein, the term "and/or" used between the last two of a list of elements means any one or more of the listed elements. For example, the phrase "A, B, and/or C" means "A," "B," "C," "A and B," "A and C," "B and C" or "A, B and C."

As used herein, the term "coupled" generally means physically coupled or linked and does not exclude the presence of intermediate elements between the coupled items absent specific contrary language.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. I therefore claim as my invention all that comes within the scope and spirit of these claims.

I claim:

1. A method of assembling a folding knife comprising:

sliding an opening in a blade of the folding knife over a non-circular locking portion, an intermediate portion, and a pivot element of a first side portion of a handle of the knife, wherein a cylindrical surface of the blade defines the opening in the blade, and the pivot element contacts the cylindrical surface of the blade and extends laterally from the first side portion of the handle and completely through the opening of the blade;

positioning a second side portion such that a non-circular opening in the second side portion is rotationally aligned with the locking portion;

sliding the opening of the second side portion over the locking portion and the intermediate portion; and rotating the opening such that the opening is rotationally offset from the locking portion.

2. The method of claim 1, wherein the opening has a hexagonal shape, the locking portion has a hexagonal shape, and wherein:

the act of positioning the second side portion comprises positioning the second side portion so that it is rotationally offset from the first side portion by 30 degrees; and the act of rotating the opening comprises rotating the second side portion by 30 degrees such that the second side portion is aligned with the first side portion.

3. A folding knife comprising:

a handle portion comprising first and second, laterally spaced side portions defining a blade-receiving cavity therebetween;

a pivot element extending from the first side portion and defining a pivot axis;

a blade having an opening, wherein the blade is pivotably connected to the pivot element and pivotable relative to the handle portion about the pivot axis between a closed position and an open position; and a locking element having a non-circular shape extending from the pivot element and having a width defined by opposing sides of the locking element taken in a plane perpendicular to the pivot axis, wherein the pivot element extends laterally from the first side portion and all the way through the opening of the blade, and the pivot element has a diameter that is greater than or equal to the width of the locking element, and wherein the second side portion comprises a non-circular opening, wherein the non-circular opening is configured to move between a first, locking position and a second, release position, wherein when the non-circular opening is in the first position, the opening is rotationally offset from the locking element, and the locking element blocks lateral movement of the second side portion relative to the first side portion, and wherein when the non-circular opening is in the second position, the opening is rotationally aligned with the locking element to allow the locking element to be moved through the opening to permit lateral movement of the second side portion away from the first side portion along the pivot axis.

4. The folding knife of claim 3, further comprising an intermediate cylindrical portion disposed between the pivot element and the locking element.

5. The folding knife of claim 4, wherein the intermediate cylindrical portion has a smaller cross section in the plane perpendicular to the pivot axis than the locking element and than the pivot element, and wherein a locking channel is defined between the locking element and the pivot element.

6. The folding knife of claim 5, wherein a width of the locking channel is sized to receive a portion of the second side portion surrounding the opening.

7. The folding knife of claim 3, wherein the locking element has a hexagonal shape and the opening has a hexagonal shape.

8. The folding knife of claim 7, wherein when the opening is in the first position, the hexagonal shape of the opening is rotationally offset from the hexagonal shape of the locking element by 30 degrees.

9. The folding knife of claim 3, wherein the locking element has a square shape and the opening has a square shape.

10. The folding knife of claim 3, wherein the locking element has a triangular shape and the opening has a triangular shape.

11. The folding knife of claim 3, wherein the locking element has a cruciform shape and the opening has a cruciform shape.

12. The folding knife of claim 3, wherein the opening passes through the entire thickness of the second side portion.

13. A folding knife comprising:

a handle portion comprising first and second, laterally spaced side portions defining a blade-receiving cavity therebetween;

a pivot element extending from the first side portion of the handle portion;

a blade pivotably connected to the pivot element and pivotable relative to the handle portion about the pivot element between a closed position and an open position, wherein the blade includes a cylindrical surface defining an opening that extends laterally through the blade from a first side portion of the blade to a second side portion of the blade; and a locking element having a non-circular shape extending from the pivot element, wherein the pivot element contacts the cylindrical surface of the blade and extends laterally from the first side portion of the handle portion, from the first side portion of the blade, completely through the opening of the blade, and to the second side portion of the blade, and wherein the second side portion comprises a non-circular opening which is adapted to be rotatable relative to the first side portion about an axis extending through the locking element between a first position and a second position, wherein when the non-circular opening is in the first position, the opening is rotationally offset from the locking element, and the locking element blocks lateral movement of the second side portion relative to the first side portion, and wherein when the non-circular opening is in the second position, the opening is rotationally aligned with the locking element to allow the locking element to be moved through the opening to permit lateral movement of the second side portion away from the first side portion along the axis.

14. The folding knife of claim 13, further comprising a securing mechanism configured to selectively retain the second side portion against rotational movement relative to the first side portion when the second side portion is in the first position.

15. The folding knife of claim 13, wherein the second side portion is rotationally aligned with the first side portion when the second side portion is in the first position.

16. The folding knife of claim 13, wherein the pivot element extends through an opening in the blade and the blade is removable from the pivot element in a direction along said axis when the second side portion is first moved away from the first side portion along said axis.

17. The folding knife of claim 13, wherein the locking element has a hexagonal cross section and the opening is hexagonal.

18. The folding knife of claim 3, wherein a cylindrical surface of the blade circumscribes the opening of the blade, and the pivot element contacts the cylindrical surface of the blade.

19. The folding knife of claim 6, wherein the portion of the second side portion received in the locking channel abuts a lateral side surface of the pivot element and a lateral side surface of the locking element.

* * * * *